US009470426B2

(12) United States Patent
Vandermeulen

(10) Patent No.: US 9,470,426 B2
(45) Date of Patent: Oct. 18, 2016

(54) IN-CEILING LIQUID DESICCANT AIR CONDITIONING SYSTEM

(71) Applicant: 7AC Technologies, Inc., Beverly, MA (US)

(72) Inventor: Peter F. Vandermeulen, Newburyport, MA (US)

(73) Assignee: 7AC Technologies, Inc., Beverly, MA (US)

( * ) Notice: Subject to any disclaimer, the term of this patent is extended or adjusted under 35 U.S.C. 154(b) by 310 days.

(21) Appl. No.: 14/303,397

(22) Filed: Jun. 12, 2014

(65) Prior Publication Data

US 2014/0366567 A1 Dec. 18, 2014

Related U.S. Application Data

(60) Provisional application No. 61/834,081, filed on Jun. 12, 2013.

(51) Int. Cl.

| | |
|---|---|
| ***F25D 23/00*** | (2006.01) |
| ***F24F 3/14*** | (2006.01) |
| ***F25B 15/00*** | (2006.01) |
| *F25B 29/00* | (2006.01) |

(52) U.S. Cl.

CPC ..... *F24F 3/1417* (2013.01); *F25B 15/00* (2013.01); *F24F 2221/14* (2013.01); *F25B 29/003* (2013.01)

(58) Field of Classification Search

CPC ..... F24F 3/1423; F24F 2203/1084; F24F 2003/144

USPC ..... 62/94, 238.3, 271, 304

See application file for complete search history.

(56) References Cited

U.S. PATENT DOCUMENTS

| | | | | |
|---|---|---|---|---|
| 1,791,086 | A | 2/1931 | Sperr | |
| 2,221,787 | A | 11/1940 | Downs et al. | |
| 2,235,322 | A | 3/1941 | Martin | |
| 2,433,741 | A | 12/1947 | Crawford | |
| 2,988,171 | A | 6/1961 | Arnold et al. | |
| 3,718,181 | A | 2/1973 | Reilly et al. | |
| 4,100,331 | A | 7/1978 | Fletcher et al. | |
| 4,102,152 | A * | 7/1978 | Covault | F25B 39/04 165/170 |
| 4,176,523 | A | 12/1979 | Rousseau | |
| 4,209,368 | A | 6/1980 | Coker et al. | |
| 4,222,244 | A | 9/1980 | Meckler | |

(Continued)

FOREIGN PATENT DOCUMENTS

| | | |
|---|---|---|
| CN | 202229469 U | 5/2012 |
| EP | 1120609 A1 | 8/2001 |

(Continued)

OTHER PUBLICATIONS

"Siphon." Encyclopedia Americana. Grolier Online, 2015. Web. Apr. 3, 2015. 1 page.

International Search Report and Written Opinion for PCT/US2014/042172, dated Oct. 20, 2014.

(Continued)

*Primary Examiner* — Melvin Jones

(74) *Attorney, Agent, or Firm* — Rajesh Vallabh; Foley Hoag LLP

(57) ABSTRACT

An air-conditioning system includes a plurality of liquid desiccant in-ceiling units, each installed in a building for treating air in a space in the building. Dedicated outside air systems (DOAS) for providing a stream of treated outside air to the building are also disclosed.

43 Claims, 14 Drawing Sheets

(56) References Cited

U.S. PATENT DOCUMENTS 4,235,221 A 11/1980 Murphy
4,239,507 A 12/1980 Benoit et al.
4,259,849 A 4/1981 Griffiths
4,324,947 A 4/1982 Dumbeck
4,429,545 A 2/1984 Steinberg
4,435,339 A 3/1984 Kragh
4,444,992 A 4/1984 Cox, III
4,583,996 A 4/1986 Sakata et al.
4,607,132 A 8/1986 Jarnagin
4,612,019 A 9/1986 Langhorst
4,649,899 A 3/1987 Moore
4,703,629 A 11/1987 Moore
4,786,301 A 11/1988 Rhodes
4,832,115 A 5/1989 Albers et al.
4,882,907 A 11/1989 Brown, II
4,887,438 A 12/1989 Meckler
4,900,448 A 2/1990 Bonne et al.
4,910,971 A 3/1990 McNab
4,939,906 A 7/1990 Spatz et al.
4,941,324 A 7/1990 Peterson et al.
4,955,205 A 9/1990 Wilkinson
4,979,965 A 12/1990 Sannholm
4,984,434 A 1/1991 Peterson et al.
4,987,750 A 1/1991 Meckler
5,181,387 A 1/1993 Meckler
5,186,903 A 2/1993 Cornwell
5,191,771 A 3/1993 Meckler
5,221,520 A 6/1993 Cornwell
5,351,497 A 10/1994 Lowenstein
5,375,429 A 12/1994 Tokizaki et al.
5,462,113 A 10/1995 Wand
5,528,905 A 6/1996 Scarlatti
5,534,186 A 7/1996 Walker et al.
5,595,690 A 1/1997 Filburn et al.
5,605,628 A 2/1997 Davidson et al.
5,638,900 A 6/1997 Lowenstein et al.
5,641,337 A 6/1997 Arrowsmith et al.
5,661,983 A 9/1997 Groten et al.
5,685,152 A 11/1997 Sterling
5,685,485 A 11/1997 Mock et al.
5,797,272 A 8/1998 James
5,832,993 A 11/1998 Ohata et al.
5,860,284 A 1/1999 Goland et al.
5,860,285 A 1/1999 Tulpule
5,928,808 A 7/1999 Eshraghi
5,933,702 A 8/1999 Goswami
6,018,954 A 2/2000 Assaf
6,083,387 A 7/2000 LeBlanc et al.
6,103,969 A 8/2000 Bussey
6,156,102 A 12/2000 Conrad et al.
6,171,374 B1 1/2001 Barton et al.
6,216,483 B1 4/2001 Potnis et al.
6,244,062 B1 6/2001 Prado
6,247,604 B1 6/2001 Taskis et al.
6,266,975 B1 7/2001 Assaf
6,417,423 B1 7/2002 Koper et al.
6,442,951 B1 9/2002 Maeda et al.
6,463,750 B2 10/2002 Assaf
6,487,872 B1 12/2002 Forkosh et al.
6,488,900 B1 12/2002 Call et al.
6,497,107 B2 * 12/2002 Maisotsenko ..... F28D 5/02 62/121
6,497,749 B2 12/2002 Kesten et al.
6,502,807 B1 1/2003 Assaf et al.
6,514,321 B1 2/2003 Lehto et al.
6,539,731 B2 4/2003 Kesten et al.
6,546,746 B2 4/2003 Forkosh et al.
6,557,365 B2 5/2003 Dinnage et al.
6,660,069 B2 12/2003 Sato et al.
6,684,649 B1 2/2004 Thompson
6,702,004 B2 * 3/2004 Stratman ..... F28D 5/02 165/115
6,739,142 B2 5/2004 Korin
6,745,826 B2 6/2004 Lowenstein et al.
6,766,817 B2 7/2004 da Silva et al.
6,854,278 B2 2/2005 Maisotsenko et al.
6,854,279 B1 2/2005 Digiovanni et al.
6,918,404 B2 7/2005 Dias da Silva et al.
6,938,434 B1 9/2005 Fair
6,976,365 B2 12/2005 Forkosh et al.
6,986,428 B2 1/2006 Hester et al.
7,066,586 B2 6/2006 da Silva et al.
RE39,288 E 9/2006 Assaf
7,143,597 B2 12/2006 Hyland et al.
7,191,821 B2 3/2007 Gronwall et al.
7,197,887 B2 4/2007 Maisotsenko et al.
7,269,966 B2 9/2007 Lowenstein et al.
7,279,215 B2 10/2007 Hester et al.
7,306,650 B2 12/2007 Slayzak et al.
7,337,615 B2 3/2008 Reidy
7,430,878 B2 10/2008 Assaf
7,758,671 B2 7/2010 Kesten et al.
7,938,888 B2 5/2011 Assaf
8,337,590 B2 12/2012 Herencia et al.
8,353,175 B2 1/2013 Wohlert
8,496,732 B2 7/2013 Culp et al.
8,500,960 B2 8/2013 Ehrenberg et al.
8,623,210 B2 1/2014 Manabe et al.
8,641,806 B2 2/2014 Claridge et al.
8,695,363 B2 4/2014 Tang et al.
8,696,805 B2 4/2014 Chang et al.
8,769,971 B2 7/2014 Kozubal et al.
8,790,454 B2 7/2014 Lee et al.
8,800,308 B2 8/2014 Vandermeulen et al.
8,876,943 B2 11/2014 Gottlieb et al.
8,881,806 B2 11/2014 Xie et al.
8,968,945 B2 3/2015 Fasold et al.
2001/0015500 A1 8/2001 Shimanuki et al.
2002/0023740 A1 2/2002 Lowenstein et al.
2002/0026797 A1 3/2002 Sundhar
2002/0098395 A1 7/2002 Shimanuki et al.
2002/0104439 A1 8/2002 Komkova et al.
2002/0139245 A1 10/2002 Kesten et al.
2002/0139320 A1 10/2002 Shimanuki et al.
2002/0148602 A1 10/2002 Nakamura
2003/0000230 A1 1/2003 Kopko
2003/0029185 A1 2/2003 Kopko
2003/0051498 A1 3/2003 Sanford
2003/0106680 A1 6/2003 Serpico et al.
2003/0230092 A1 12/2003 Lowenstein et al.
2004/0061245 A1 4/2004 Maisotsenko et al.
2004/0109798 A1 6/2004 Chopard et al.
2004/0134212 A1 7/2004 Lee et al.
2004/0168462 A1 9/2004 Assaf
2004/0194944 A1 10/2004 Hendricks et al.
2004/0211207 A1 10/2004 Forkosh et al.
2004/0231512 A1 11/2004 Slayzak et al.
2005/0109052 A1 5/2005 Albers et al.
2005/0133082 A1 6/2005 Konold et al.
2005/0210907 A1 9/2005 Gillan et al.
2005/0218535 A1 10/2005 Maisotsenko et al.
2005/0257551 A1 11/2005 Landry
2006/0042295 A1 3/2006 Assaf
2006/0156750 A1 7/2006 Lowenstein et al.
2006/0278089 A1 12/2006 Theilow
2007/0175234 A1 8/2007 Pruitt
2007/0234743 A1 10/2007 Assaf
2008/0127965 A1 6/2008 Burton
2008/0156471 A1 7/2008 Han et al.
2008/0196758 A1 8/2008 McGuire
2008/0302357 A1 12/2008 DeNault
2009/0000732 A1 1/2009 Jacobine et al.
2009/0095162 A1 4/2009 Hargis et al.
2009/0200022 A1 8/2009 Bravo et al.
2010/0000247 A1 1/2010 Bhatti et al.
2010/0018322 A1 1/2010 Neitzke et al.
2010/0051083 A1 3/2010 Boyk
2010/0084120 A1 4/2010 Yin et al.
2010/0170776 A1 7/2010 Ehrenberg et al.
2010/0319370 A1 12/2010 Kozubal et al.
2011/0100618 A1 5/2011 Carlson
2011/0126885 A1 6/2011 Kokotov et al.
2012/0114527 A1 5/2012 Hoglund et al.
2012/0118148 A1 5/2012 Culp et al.

(56) References Cited

U.S. PATENT DOCUMENTS

| | | | |
|---|---|---|---|
| 2012/0118155 | A1 | 5/2012 | Claridge et al. |
| 2012/0125020 | A1 | 5/2012 | Vandermeulen et al. |
| 2012/0131937 | A1 | 5/2012 | Vandermeulen et al. |
| 2012/0131939 | A1 | 5/2012 | Vandermeulen et al. |
| 2012/0132513 | A1 | 5/2012 | Vandermeulen et al. |
| 2012/0152318 | A1 | 6/2012 | Kee |
| 2013/0056177 | A1 | 3/2013 | Coutu et al. |
| 2013/0101909 | A1 | 4/2013 | Fasold et al. |
| 2013/0186121 | A1 | 7/2013 | Erb et al. |
| 2013/0199220 | A1 | 8/2013 | Ma et al. |
| 2013/0227982 | A1 | 9/2013 | Forkosh |
| 2013/0255287 | A1 | 10/2013 | Forkosh |
| 2013/0340449 | A1 | 12/2013 | Kozubal et al. |
| 2014/0054004 | A1 | 2/2014 | LePoudre et al. |
| 2014/0054013 | A1 | 2/2014 | LePoudre et al. |
| 2014/0150481 | A1 | 6/2014 | Vandermeulen |
| 2014/0150656 | A1 | 6/2014 | Vandermeulen |
| 2014/0150657 | A1 | 6/2014 | Vandermeulen et al. |
| 2014/0150662 | A1 | 6/2014 | Vandermeulen et al. |
| 2014/0223947 | A1 | 8/2014 | Ranjan et al. |
| 2014/0245769 | A1 | 9/2014 | Vandermeulen et al. |
| 2014/0260367 | A1 | 9/2014 | Coutu et al. |
| 2014/0260369 | A1 | 9/2014 | LePoudre |
| 2014/0260371 | A1 | 9/2014 | Vandermeulen |
| 2014/0260398 | A1 | 9/2014 | Kozubal et al. |
| 2014/0260399 | A1 | 9/2014 | Vandermeulen |
| 2014/0262125 | A1 | 9/2014 | Erb et al. |
| 2014/0262144 | A1 | 9/2014 | Erb et al. |
| 2014/0264968 | A1 | 9/2014 | Erb et al. |
| 2014/0360373 | A1 | 12/2014 | Peacos et al. |
| 2014/0366567 | A1 | 12/2014 | Vandermeulen |

FOREIGN PATENT DOCUMENTS

| | | | |
|---|---|---|---|
| EP | 1563229 | A1 | 8/2005 |
| EP | 1781995 | A1 | 5/2007 |
| EP | 2256434 | A2 | 12/2010 |
| EP | 2306100 | A1 | 4/2011 |
| JP | 02306067 | A | 12/1990 |
| JP | H08-105669 | A | 4/1996 |
| JP | H11-351700 | A | 12/1999 |
| JP | 2002206834 | A | 7/2002 |
| JP | 2006-263508 | A | 10/2006 |
| JP | 2006-529022 | A | 12/2006 |
| JP | 04273555 | B2 | 6/2009 |
| JP | 2009-293831 | A | 12/2009 |
| JP | 2010-247022 | A | 11/2010 |
| KR | 20040026242 | A | 3/2004 |
| KR | 10-0510774 | B1 | 8/2005 |
| WO | 9922180 | A1 | 5/1999 |
| WO | 0011426 | A1 | 3/2000 |
| WO | 0055546 | A1 | 9/2000 |
| WO | 03004937 | A1 | 1/2003 |
| WO | 2004046618 | A1 | 6/2004 |
| WO | 2006006177 | A1 | 1/2006 |
| WO | 2008037079 | A1 | 4/2008 |
| WO | 2009094032 | A1 | 7/2009 |
| WO | 2009144880 | A1 | 12/2009 |
| WO | 2011062808 | A1 | 5/2011 |
| WO | 2011161547 | A2 | 12/2011 |
| WO | 2012-082093 | A1 | 6/2012 |

OTHER PUBLICATIONS

1-Open Absorption System for Cooling and Air Conditioning using Membrane Contactors—Annual Report 2005, Publication Number: Publication 260097, Project: 101310—Open Absorption System for Cooling and Air Conditioning using Membrane Contactors, Date of publication: Jan. 31, 2006, Author: Manuel Conde-Petit, Robert Weber, Contractor: M. Conde Engineering.

2-Open Absorption System for Cooling and Air Conditioning using Membrane Contactors—Annual, Report 2006, Publication Number: Publication 260098, Project: 101310—Open Absorption System for Cooling and Air Conditioning using Membrane Contactors, Date of publication: Nov. 14, 2006, Author: Manuel Conde-Petit, Robert Weber, Contractor: M. Conde Engineering.

3-Open Absorption System for Cooling and Air Conditioning Using Membrane Contactors—Final Report, Publication Number: Publication 280139, Project: 101310—Open Absorption System for Cooling and Air Conditioning using Membrane Contactors, Date of publication: Jul. 8, 2008, Author: Viktor Dorer, Manuel Conde-Petit, Robert Weber, Contractor: M. Conde Engineering.

4-Conde-Petit, M. 2007. Liquid Desiccant-Based Air-Conditioning Systems—LDACS, Proc. of the 1st European Conference on Polygeneration—Technologies and Applications, 217-234, A. Coronas, ed., Tarragona—Spain, Oct. 16-17, Published by Crever—Universitat Rovira I Virgili, Tarragona, Spain.

5-Conde-Petit, M. 2008. Open Absorption Systems for Air-Conditioning using Membrane Contactors,Proceedings '15. Schweizerisches Status-Seminar <<Energie- und Umweltforschung im Bauwesen', Sep. 11-12—ETH Zurich, Switzerland. Published by Brenet—Eggwilstr. 16a, CH-9552 Bronschhofen—Switzerland (brenet@vogel-tech.ch).

6-Third Party Observations for PCT/US2011/037936, dated Sep. 24, 2012.

Ash Rae, et al., "Desiccant Dehumidification and Pressue Drying Equipment," 2012 Ashrae Handbook—HVAC Systems and Equipment, Chapter 24, pp. 24.1-24.12.

Beccali, et al., "Energy and Economic Assessment of Desiccant Cooling," Solar Energy, Issue 83, pp. 1828-1846, Aug. 2009.

Fimbres-Weihs, et al., "Review of 3D CFD modeling of flow and mass transfer in narrow spacer-filled channels in membrane modules," Chemical Engineering and Processing 49 (2010) pp. 759-781.

Li, F. et al "Novel spacers for mass transfer enhancement in membrane separations," Journal of Membrane Science, 253 (2005), pp. 1-12.

Li, Y., et al., "CFD simulation of fluid flow through spacer-filled membrane module: selecting suitable cell types for periodic boundary conditions," Desalination 233 (2008) pp. 351-358.

Liu, et al., "Research Progress in Liquid Desiccant Air Conditioning Devices and Systems," Frontiers of Energy and Power Engineering in China, vol. 4, Issue 1, pp. 55-65, Feb. 2010.

Lowenstein, "A Solar Liquid-Desiccant Air Conditioner," Solar 2003, Proceedings of the 32nd ASES Annual Conference, Austin, TX, Jul. 2003.

Mathioulakis, "Desalination by Using Alternative Energy," Desalination, Issue 203, pp. 346-365, 2007.

Russell, et al., "Optimization of Photovolatic Thermal Collector Heat Pump Systems," ISES International Solar Energy Conference, Atlanta, GA, vol. 3, pp. 1870-1874, May 1979.

Welty, "Liquid Desiccant Dehumidification," Engineered Systems, May 2010, vol. 27 Issue 5, p. 34.

* cited by examiner

IN-CEILING LIQUID DESICCANT AIR CONDITIONING SYSTEM

CROSS REFERENCE TO RELATED APPLICATION

This application claims priority from U.S. Provisional Patent Application No. 61/834,081 filed on Jun. 12, 2013 entitled IN-CEILING LIQUID DESICCANT SYSTEM FOR DEHUMIDIFICATION, which is hereby incorporated by reference.

BACKGROUND

The present application relates generally to the use of liquid desiccant membrane modules to dehumidify and cool an air stream entering a space. More specifically, the application relates to the use of micro-porous membranes to separate the liquid desiccant from the air stream wherein the fluid streams (air, heat transfer fluids, and liquid desiccants) are made to flow turbulently so that high heat and moisture transfer rates between the fluids can occur. The application further relates to the application of such membrane modules to locally dehumidify spaces in buildings with the support of external cooling and heating sources by placing the membrane modules in or near suspended ceilings.

Liquid desiccants have been used in parallel to conventional vapor compression HVAC equipment to help reduce humidity in spaces, particularly in spaces that either require large amounts of outdoor air or that have large humidity loads inside the building space itself. Humid climates, such as for example Miami, Fla. require a large amount of energy to properly treat (dehumidify and cool) the fresh air that is required for a space's occupant comfort. Conventional vapor compression systems have only a limited ability to dehumidify and tend to overcool the air, oftentimes requiring energy intensive reheat systems, which significantly increases the overall energy costs because reheat adds an additional heat-load to the cooling coil or reduces the net-cooling provided to the space. Liquid desiccant systems have been used for many years and are generally quite efficient at removing moisture from the air stream. However, liquid desiccant systems generally use concentrated salt solutions such as solutions of LiCl, LiBr or CaCl2 and water. Such brines are strongly corrosive, even in small quantities, so numerous attempts have been made over the years to prevent desiccant carry-over to the air stream that is to be treated. One approach—generally categorized as closed desiccant systems—is commonly used in equipment dubbed absorption chillers, places the brine in a vacuum vessel which then contains the desiccant. Since the air is not directly exposed to the desiccant, such systems do not have any risk of carry-over of desiccant particles to the supply air stream. Absorption chillers however tend to be expensive both in terms of first cost and maintenance costs. Open desiccant systems allow a direct contact between the air stream and the desiccant, generally by flowing the desiccant over a packed bed similar to those used in cooling towers. Such packed bed systems suffer from other disadvantages besides still having a carry-over risk: the high resistance of the packed bed to the air stream results in larger fan power and pressure drops across the packed bed, thus requiring more energy. Furthermore, the dehumidification process is adiabatic, since the heat of condensation that is released during the absorption of water vapor into the desiccant has no place to go. As a result both the desiccant and the air stream are heated by the release of the heat of condensation.

This results in a warm, dry air stream where a cool dry air stream was desired, necessitating the need for a post-dehumidification cooling coil. Warmer desiccant is also exponentially less effective at absorbing water vapor, which forces the system to supply much larger quantities of desiccant to the packed bed which in turn requires larger desiccant pump power, since the desiccant is doing double duty as a desiccant as well as a heat transfer fluid. The larger desiccant flooding rate also results in an increased risk of desiccant carryover. Generally air flow rates in open desiccant systems need to be kept well below the turbulent region (at Reynolds numbers of less than ~2,400) to prevent carry-over of desiccant to the air stream.

Modern multi-story buildings typically separate the outside air supply that is required for occupant comfort as well as air quality concerns from the sensible cooling or heating that is also required to keep the space at a required temperature. Oftentimes in such buildings the outside air is provided by a duct system in a suspended ceiling to each and every space from a central outside air handling unit. The outside air handling unit dehumidifies and cools the air, typically to a temperature slightly below room neutral temperatures (65-70F) and a relative humidity level of about 50% and delivers the treated outside air to each space. In addition, in each space one or more fan-coil units (often called Variable Air Volume units) are installed that remove some air from the space, lead it through a water cooled or heated coils and bring it back into the space.

Between the outside air handling unit and the fan-coil units, the space conditions can usually be maintained at proper levels. However, it is well possible that in certain conditions, for example if outside air humidity is high, or if a significant amount of humidity is created within the space or if windows are opened allowing for excess air to enter the space, the humidity in the space raises to the point where the fan-coil in the suspended ceiling starts to condense water on the cold surfaces of the coil, leading to potential water damage and mold growth. Generally condensation in a ceiling mounted fan-coil is undesirable for that reason.

There thus remains a need for a system that provides a cost efficient, manufacturable and thermally efficient method to capture moisture from an air stream in a ceiling location, while simultaneously cooling such an air stream and while also eliminating the risk of condensation of such an air stream on cold surfaces. Furthermore such a system needs to be compatible with existing building infrastructure and physical sizes need to be comparable to existing fan-coil units.

BRIEF SUMMARY

Provided herein are methods and systems used for the efficient dehumidification of an air stream using a liquid desiccant. In accordance with one or more embodiments, the liquid desiccant flows down the face of a thin support plate as a falling film and the liquid desiccant is covered by a membrane, while an air stream is blown over the membrane. In some embodiments, a heat transfer fluid is directed to the side of the support plate opposite the liquid desiccant. In some embodiments, the heat transfer fluid is cooled so that the support plate is cooled which in turn cools the liquid desiccant on the opposite side of the support plate. In some embodiments, the cool heat transfer fluid is provided by a central chilled water facility. In some embodiments, the thus cooled liquid desiccant cools the air stream. In some embodiments, the liquid desiccant is a halide salt solution. In some embodiments, the liquid desiccant is Lithium Chloride and water. In some embodiments, the liquid desiccant is Calcium Chloride and water. In some embodiments, the liquid desiccant is a mixture of Lithium Chloride, Calcium Chloride and water. In some embodiments, the membrane is a micro-porous polymer membrane. In some embodiments, the heat transfer fluid is heated so that the support plate is heated which in turn heats the liquid desiccant. In some embodiments, the thus heated liquid desiccant heats the air stream. In some embodiments, the hot heat transfer fluid is provided by a central hot water facility such as a boiler or combined heat and power facility. In some embodiments, the liquid desiccant concentration is controlled to be constant. In some embodiments, the concentration is held at a level so that the air stream over the membrane exchanges water vapor with the liquid desiccant in such a way that the air stream has a constant relative humidity. In some embodiments, the liquid desiccant is concentrated so that the air stream is dehumidified. In some embodiments, the liquid desiccant is diluted so that the air stream is humidified. In some embodiments, the membrane, liquid desiccant plate assembly is placed at a ceiling height location. In some embodiments, the ceiling height location is a suspended ceiling. In some embodiments, an air stream is removed from below the ceiling height location, directed over the membrane/liquid desiccant plate assembly where the air stream is heated or cooled as the case may be and is humidified or dehumidified as the case may be and directed back to the space below the ceiling height location.

In accordance with one or more embodiments, the liquid desiccant is circulated by a liquid desiccant pumping loop. In some embodiments, the liquid desiccant is collected near the bottom of the support plate into a collection tank. In some embodiments, the liquid desiccant in the collection tank is refreshed by a liquid desiccant distribution system. In some embodiments, the heat transfer fluid is thermally coupled through a heat exchanger to a main building heat transfer fluid system. In some embodiments, the heat transfer fluid system is a chilled water loop system. In some embodiments, the heat transfer fluid system is a hot water loop system or a steam loop system.

In accordance with one or more embodiments, the ceiling height mounted liquid desiccant membrane plate assembly receives concentrated or diluted liquid desiccant from a central regeneration facility. In some embodiments, the regeneration facility is a central facility serving multiple ceiling height mounted liquid desiccant membrane plate assemblies. In some embodiments, the central regeneration facility also serves a liquid desiccant Dedicated Outside Air System (DOAS). In some embodiments, the DOAS provides outside air to the various spaces in a building. In some embodiments, the DOAS is a conventional DOAS not utilizing liquid desiccants.

In accordance with one or more embodiments, a liquid desiccant DOAS provides a stream of treated outside air to a duct distribution system in a building. In some embodiments, the liquid desiccant DOAS comprises several sets of liquid desiccant membrane plate assemblies with heat transfer fluids for removing or adding heat to the liquid desiccants. In some embodiments, a first set of liquid desiccant membrane plates receives a stream of outside air. In some embodiments, the first set of liquid desiccant membrane plates also receives a cold heat transfer fluid. In some embodiments, the air stream leaving the first set of liquid desiccant membrane plates is directed to a second set of liquid desiccant membrane plates, which also receives a cold heat transfer fluid. In some embodiments, the second set of plates receives a concentrated liquid desiccant. In some embodiments, the concentrated liquid desiccant is provided by a central liquid desiccant regeneration facility. In some embodiments, the air treated by the second set of liquid desiccant membrane plates is directed towards a building and distributed to various spaces therein. In some embodiments, an amount of air is removed from said spaces and returned back to the liquid desiccant DOAS. In some embodiments, the return air is directed to a third set of liquid desiccant membrane plates. In some embodiments, the third set of liquid desiccant membrane plates receives a hot heat transfer fluid. In some embodiments, the hot heat transfer fluid is provided by a central hot water facility. In some embodiments, the central hot water facility is a boiler room, or a central heat and power facility. In some embodiments, the first set of liquid desiccant membrane plates receives a liquid desiccant from the third set of liquid desiccant membrane plates through a heat exchanger. In some embodiments, the liquid desiccant is circulated by a liquid desiccant pumping system, and utilizes one or more liquid desiccant collection tanks.

In accordance with one or more embodiments, a liquid desiccant DOAS provides a stream of treated outside air to a duct distribution system in a building. In some embodiments, the liquid desiccant DOAS comprises several sets of liquid desiccant membrane plate assemblies with heat transfer fluids for removing or adding heat to the liquid desiccants. In some embodiments, a first set of liquid desiccant membrane plates receives a stream of outside air. In some embodiments, the air stream leaving the first set of liquid desiccant membrane plates is directed to a second set of liquid desiccant membrane plates, which receive a cold heat transfer fluid. In some embodiments, the second set of plates receives a concentrated liquid desiccant. In some embodiments, the concentrated liquid desiccant is provided by a central liquid desiccant regeneration facility. In some embodiments, the air treated by the second set of liquid desiccant membrane plates is directed towards a building and distributed to various spaces therein. In some embodiments, an amount of air is removed from said spaces and returned back to the liquid desiccant DOAS. In some embodiments, the return air is directed to a third set of liquid desiccant membrane plates. In some embodiments, the first set of liquid desiccant membrane plates receives a liquid desiccant from the third set of liquid desiccant membrane plates. In some embodiments, the first set of liquid desiccant membrane plates also receives a heat transfer fluid from the third set of plates. In some embodiments, the system recovers both sensible and latent energy from the return air stream entering the third set of liquid desiccant membrane plates. In some embodiments, the liquid desiccant is circulated by a liquid desiccant pumping system, and utilizes one or more liquid desiccant collection tanks. In some embodiments, the heat transfer fluid is circulated between the first set of liquid desiccant membrane plates and the third set of liquid desiccant membrane plates.

In accordance with one or more embodiments, a liquid desiccant DOAS provides a stream of treated outside air to a duct distribution system in a building. In some embodiments, the liquid desiccant DOAS comprises several sets of liquid desiccant membrane plate assemblies with heat transfer fluids for removing or adding heat to the liquid desiccants. In some embodiments, a first set of liquid desiccant membrane plates receives a stream of outside air. In some embodiments, the air stream leaving the first set of liquid desiccant membrane plates is directed to a second set of liquid desiccant membrane plates, which receive a cold heat transfer fluid. In some embodiments, the second set of plates receives a concentrated liquid desiccant. In some embodiments, the concentrated liquid desiccant is provided by a central liquid desiccant regeneration facility. In some embodiments, the air treated by the second set of liquid desiccant membrane plates is directed towards a building and distributed to various spaces therein. In some embodiments, an amount of air is removed from said spaces and returned back to the liquid desiccant DOAS. In some embodiments, this return air is directed to a third set of liquid desiccant membrane plates. In some embodiments, the first set of liquid desiccant membrane plates receives a liquid desiccant from the third set of liquid desiccant membrane. In some embodiments, the first set of liquid desiccant membrane plates also receives a heat transfer fluid from the third set of plates. In some embodiments, the system recovers both sensible and latent energy from the return air stream entering the third set of liquid desiccant membrane plates. In some embodiments, the air leaving the third set of liquid desiccant membrane plates is directed to a fourth set of liquid desiccant membrane plates. In some embodiments, the fourth set of liquid desiccant membrane plates receives a hot heat transfer fluid from a central hot water facility. In some embodiments, the hot heat transfer fluid received by the fourth set of liquid desiccant membrane plates is used to regenerate the liquid desiccant present in the fourth set of liquid desiccant membrane plates. In some embodiments, the concentrated liquid desiccant from the fourth set of liquid desiccant membrane plates is directed to the second set of liquid desiccant membrane plates by a liquid desiccant pumping system through a heat exchanger. In some embodiments, the liquid desiccant between the first and third set of liquid desiccant membrane plates is circulated by a liquid desiccant pumping system, and utilizes one or more liquid desiccant collection tanks. In some embodiments, a heat transfer fluid is circulated between the first and third set of liquid desiccant membrane plates so as to transfer sensible energy between the first and third set of liquid desiccant membrane plates.

In accordance with one or more embodiments, a liquid desiccant DOAS provides a stream of treated outside air to a duct distribution system in a building. In some embodiments, the liquid desiccant DOAS comprises several sets of liquid desiccant membrane plate assemblies and conventional cooling or heating coils with heat transfer fluids for removing or adding heat to the liquid desiccants and heating and cooling coils. In some embodiments, a first cooling coil receives a stream of outside air. In some embodiments, the first cooling coil also receives a cold heat transfer fluid in such a way as to condense moisture out of the outside air stream. In some embodiments, the air stream leaving the first set cooling coil is directed to a first set of liquid desiccant membrane plates, which also receive a cold heat transfer fluid. In some embodiments, the first set of liquid desiccant membrane plates receives a concentrated liquid desiccant. In some embodiments, the air treated by the first set of liquid desiccant membrane plates is directed towards a building and distributed to various spaces therein. In some embodiments, an amount of air is removed from said spaces and returned back to the liquid desiccant DOAS. In some embodiments, this return air is directed to a first hot water coil. In some embodiments, the first hot water coils receives hot water from a central hot water facility. In some embodiments, the hot water facility is a central boiler system. In some embodiments, the central hot water system is a combined heat and power facility. In some embodiments, the air leaving the first hot water coil is directed to a second set of liquid desiccant membrane plates. In some embodiments, the second set of liquid desiccant membrane plates also receives a hot heat transfer fluid from a central hot water facility. In some embodiments, the hot heat transfer fluid received by the second set of liquid desiccant membrane plates is used to regenerate the liquid desiccant present in the second set of liquid desiccant membrane plates. In some embodiments, the concentrated liquid desiccant from the second set of liquid desiccant membrane plates is directed to the first set of liquid desiccant membrane plates by a liquid desiccant pumping system through a heat exchanger. In some embodiments, the liquid desiccant between the first and second set of liquid desiccant membrane plate is circulated by a liquid desiccant pumping system, and utilizes one or more liquid desiccant collection tanks.

In accordance with one or more embodiments, a liquid desiccant DOAS is providing a stream of treated outside air to a duct distribution system in a building. In some embodiments, the liquid desiccant DOAS comprises a first and a second set of liquid desiccant membrane module assemblies and a conventional water-to-water heat pump system. In some embodiments, the water-to-water heat pump system is thermally coupled to a building's chilled water loops. In some embodiments, one of a first set of membrane modules is exposed to the outside air is also thermally coupled to the buildings chilled water loop. In some embodiments, the water-to-water heat pump is coupled so that it cools the building cooling water before it reaches the first set of membrane modules resulting in a lower supply air temperature from the membrane modules. In some embodiments, the water-to-water heap pump is coupled so that it cools the building cooling water after is has interacted with the first set of membrane modules resulting in a higher supply air temperature to the building. In some embodiments, the system is set up to control the temperature of the supply air to the building by controlling how the water from the building flows to the water-to-water heat pump and the first set of membrane modules. In accordance with one or more embodiments, the water-to-water heat pump provides hot water or hot heat transfer fluid to a second set of membrane modules. In some embodiments, the heat form the hot heat transfer fluid is used to regenerate a liquid desiccant in the membrane modules. In some embodiments, the second set of membrane modules receives return air from the building. In some embodiments, the second set of membrane modules receives outside air from the building. In some embodiments, the second set of membrane modules receives a mixture of return air and outside air. In some embodiments, the outside air directed to the first set of membrane modules is pre-treated by a first section of an energy recovery system and air directed to the second set of membrane modules is pre-treated by a second section of an energy recovery system. In some embodiments, the energy recovery system is a desiccant wheel, an enthalpy wheel, a heat wheel or the like. In some embodiments, the energy recovery system comprises a set of heat pipes or an air to air heat exchanger or any convenient energy recovery device. In some embodiments, the energy recovery is accomplished with a third and a fourth set of membrane modules wherein the sensible and/or the latent energy is recovered and passed between the third and fourth set of membrane modules.

In no way is the description of the applications intended to limit the disclosure to these applications. Many construction variations can be envisioned to combine the various elements mentioned above each with its own advantages and disadvantages. The present disclosure in no way is limited to a particular set or combination of such elements.

DETAILED DESCRIPTION

Figure 1:
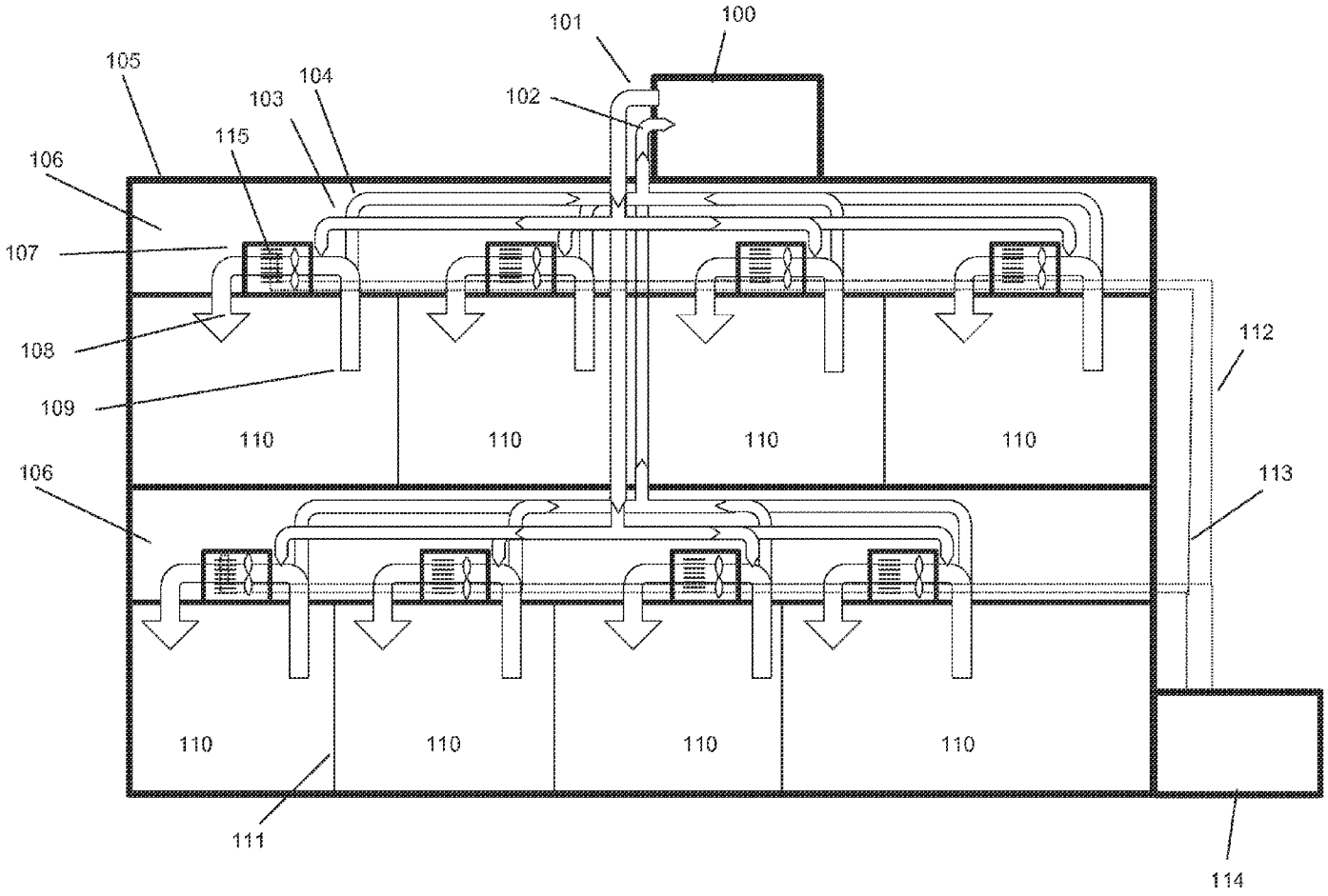
FIG. 1 illustrates a multistory building wherein a central outside air-handling unit provides fresh air to spaces and a central chiller plant provides cold or hot water for cooling or heating the spaces.

FIG. 1 depicts a typical implementation of an air conditioning system for a modern building wherein the outside air and the space cooling and heating are provided by separate systems. Such implementations are known in the industry as Dedicated Outside Air Systems or DOAS. The example building has two stories with a central air handling unit 100 on the roof 105 of the building. The central air handling unit 100 provides a treated fresh air stream 101 to the building that has a temperature that is usually slightly below room neutral conditions (65-70F) and has a relative humidity of 50% or so. A ducting system 103 provides air to the various spaces and can be ducted to the spaces directly or into a fan-coil unit 107 mounted in a suspended ceiling cavity 106. The fan-coil unit 107 draws air 109 from the space 110 and pushes it through a cooling or heating coil 115 mounted inside the fan-coil unit 107. The cooled or heated air 108 is then directed back into the space where it provides a comfortable environment for occupants. To maintain air quality some of the air 109 that is removed from the space and is exhausted through ducts 104 and directed back to the central air handling unit 100. Since the return air 102 to the air handling unit 100 is still relatively cool and dry (in summer or warm and moist in winter as the case may be), the central air handling unit 100 can be constructed so as to recover or use some of the energy present in the return air stream. This is oftentimes accomplished with total energy wheels, enthalpy wheels, desiccant wheels, air to air energy recovery units, heat pipes, heat exchangers and the like.

The fan coils 115 in FIG. 1 also require cold water (for cooling operation) or warm water (for heating operation). Installing water lines in buildings is expensive and oftentimes only a single water loop is installed. This can cause problems in certain situations where some spaces may require cooling and other spaces may require heating. In buildings where a hot water- and a cold water loop are available at the same time, this problem can be solved by having some fan coil units 115 provide cooling where others are providing heating to the respective spaces. Spaces 110 can often be divided into zones by physical walls 111 or by physical separation of fan-coil units.

The fan coil units 107 thus utilize some form of hot and cold water supply system 112 as well as a return system 113. A central boiler and/or chiller plant 114 is usually available to provide the required hot and/or cold water to the fan-coil units.

Figure 2:
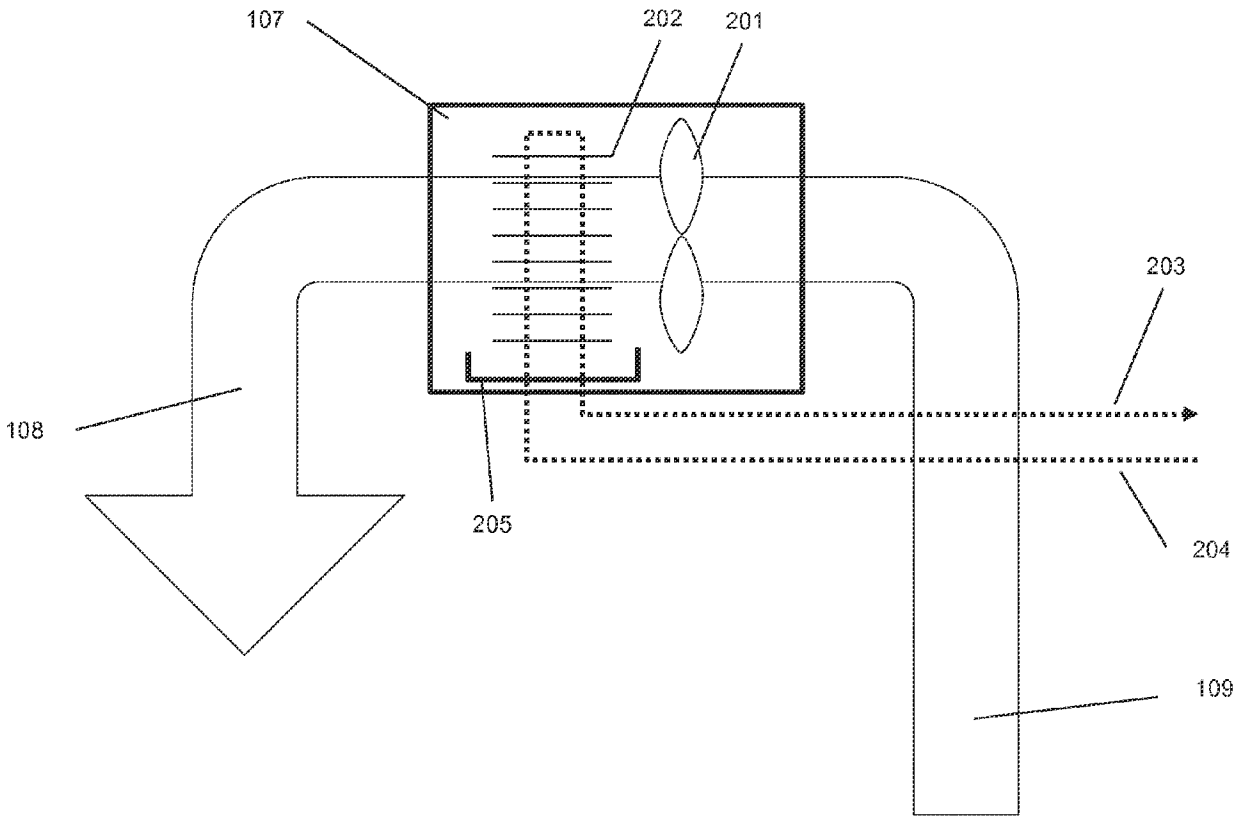
FIG. 2 shows a detailed schematic of a ceiling mounted fan-coil unit as used in FIG. 1.

FIG. 2 illustrates a more detailed view of a fan-coil unit 107. The unit includes a fan 201, which removes air 109 from the space below. The fan pushes air through the coil 202 which has a water supply line 204, a water return line 203. The heat in the air 109 is rejected to the cooling water 204 thereby producing colder air 108 and warmer water 203. If the air 109 entering the coil is already relatively humid, it is possible for condensation to occur on the coil since the cooling water is typically provided at temperatures of 50F or below. A drain pan 205 is then required to be installed and condensed water is required to be drained so as to not create problems with standing water which can result in fungi, bacteria and other potentially disease causing agents such as legionnaires. Modern buildings are often much more air-tight than older buildings which can amplify the humidity control problem. Furthermore in modern buildings, internally generated heat is better retained resulting in a greater demand for cooling earlier in the season. The two effects combine to increase the humidity in the space and result in larger energy consumption than might have been expected.

Figure 3:
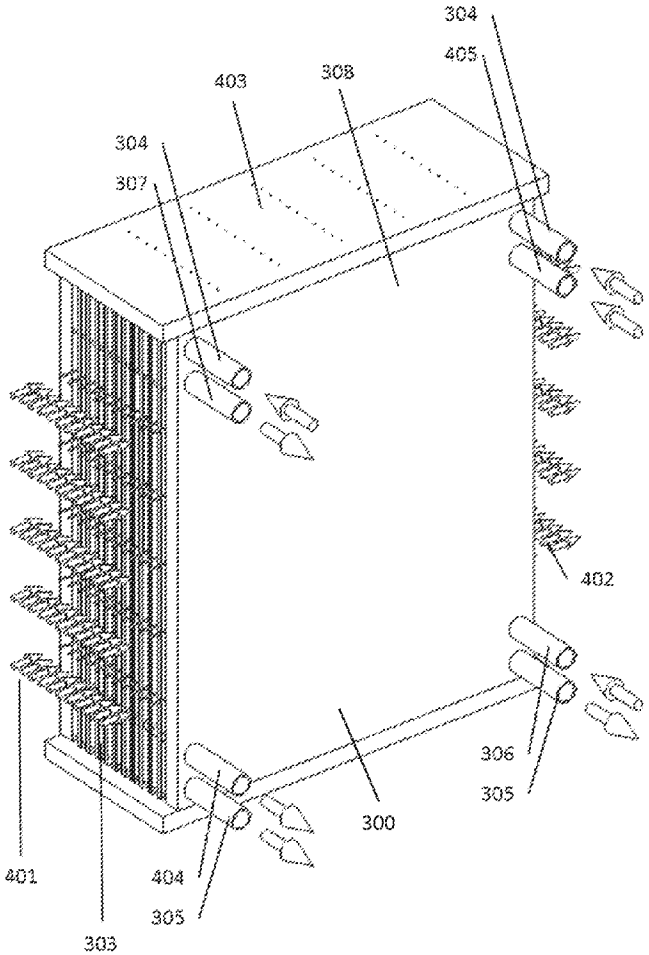
FIG. 3 shows a 3-way liquid desiccant membrane module that is able to dehumidify and cool a horizontal air stream.

FIG. 3 shows a flexible, membrane protected, counter-flow 3-way heat and mass exchanger disclosed in U.S. Patent Application Publication No. 20140150662 meant for capturing water vapor from an air stream while simultaneously cooling or heating the air stream. For example, a high temperature, high humidity air stream 401 enters a series of membrane plates 303 that cool and dehumidify the air stream. The cool, dry, leaving air 402 is supplied to a space such as, e.g., a space in a building. A desiccant is supplied through supply ports 304. Two ports 304 are provided on each side of the plate block structure 300 to ensure uniform desiccant distribution on the membrane plates 303. The desiccant film falls through gravity and is collected at the bottom of the plates 303 and exits through the drain ports 305. A cooling fluid (or heating fluid as the case may be) is supplied through ports 405 and 306. The cooling fluid supply ports are spaced in such a way as to provide uniform cooling fluid flow inside the membrane plates 303. The cooling fluid runs counter to the air stream direction 401 inside the membrane plates 303 and leaves the membrane plates 303 through ports 307 and 404. Front/rear covers 308 and top/bottom covers 403 provide structural support and thermal insulation and ensure that air does not leave through the sides of the heat and mass exchanger.

Figure 4:
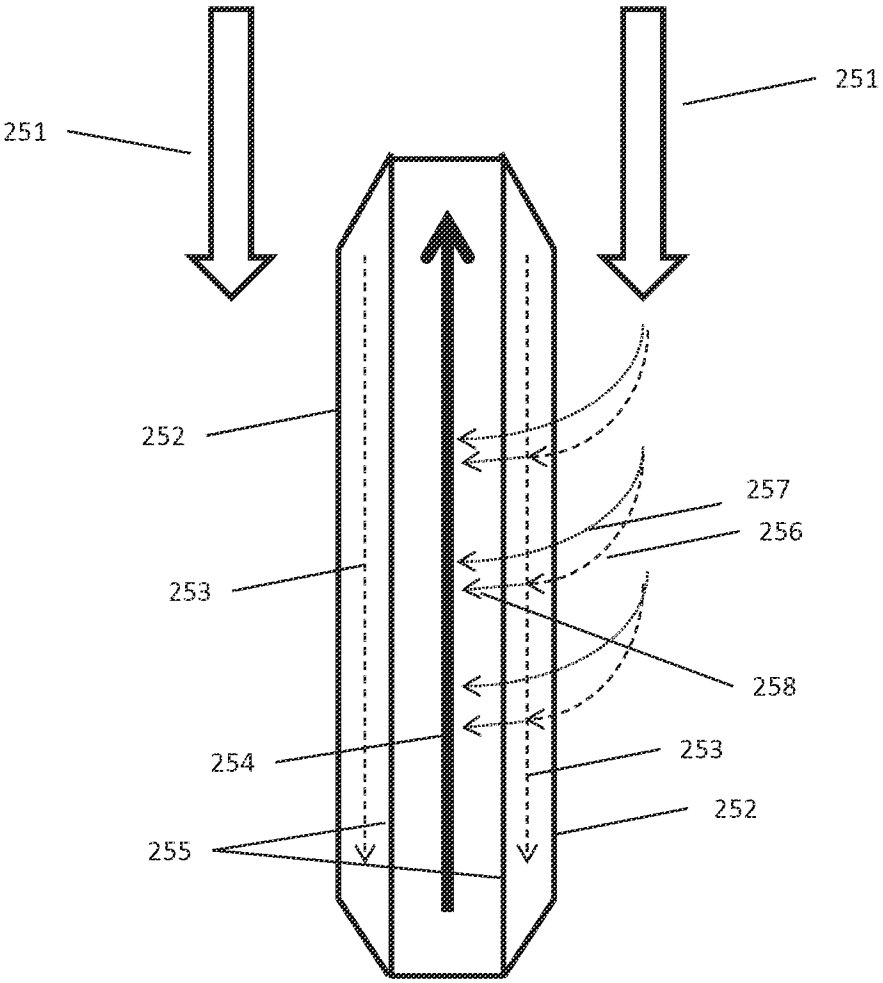
FIG. 4 illustrates a concept of a single membrane plate structure in the liquid desiccant membrane module of FIG. 3.

FIG. 4 shows a schematic detail of one of the plate structures of FIG. 3. The air stream 251 flows counter to a cooling fluid stream 254. Membranes 252 contain a liquid desiccant 253 that falls along the wall 255 that contains a heat transfer fluid 254. Water vapor 256 entrained in the air stream is able to transition the membrane 252 and is absorbed into the liquid desiccant 253. The heat of condensation of water 258 that is released during the absorption is conducted through the wall 255 into the heat transfer fluid 254. Sensible heat 257 from the air stream is also conducted through the membrane 252, liquid desiccant 253 and wall 255 into the heat transfer fluid 254.

Figure 5:
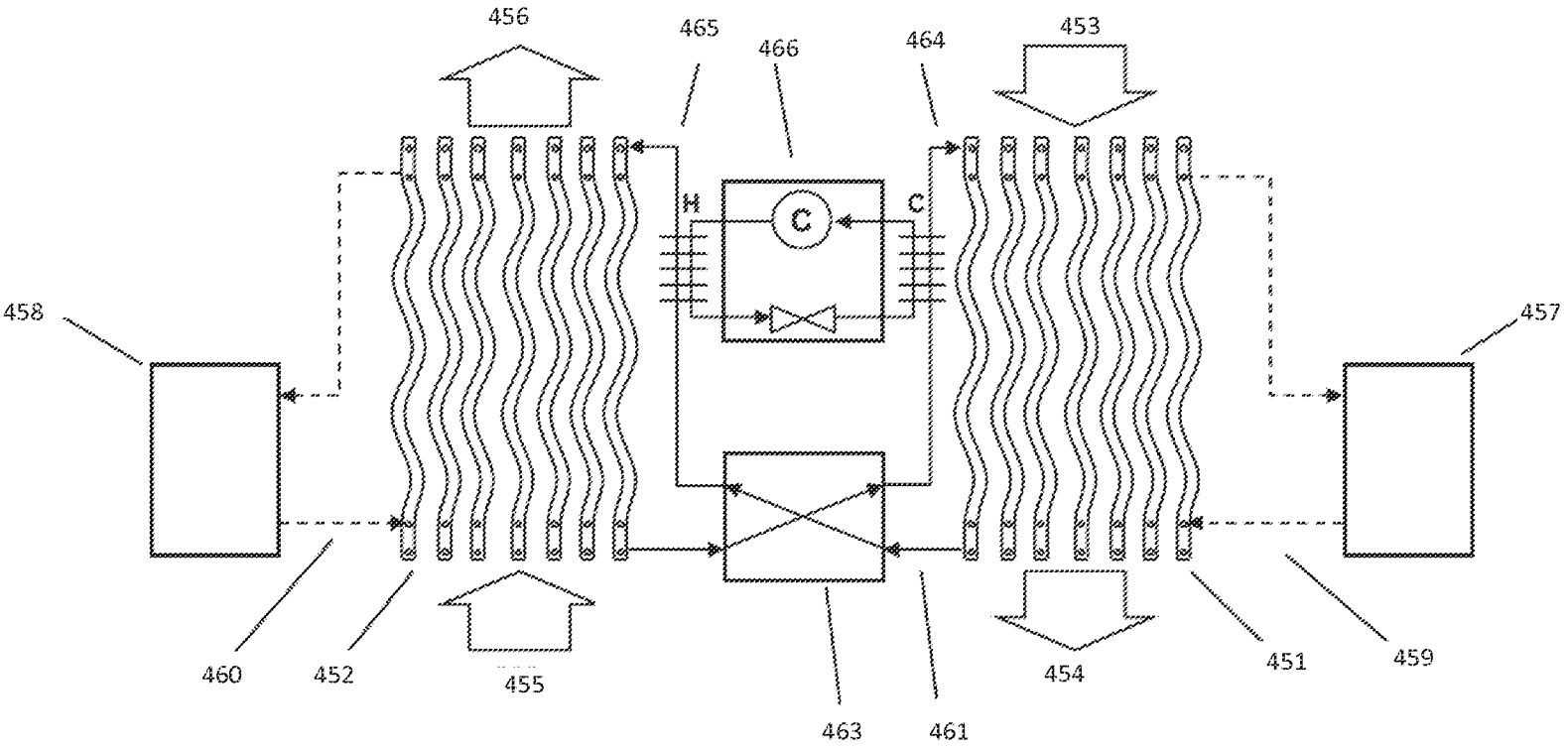
FIG. 5 illustrates a liquid desiccant membrane dehumidification and cooling system in the prior art that is able to treat 100% outside air.

FIG. 5 shows a new type of liquid desiccant system as shown in U.S. Patent Application Publication No. 20120125020. The conditioner 451 comprises a set of plate structures that are internally hollow. A cold heat transfer fluid is generated in cold source 457 and entered into the plates. Liquid desiccant solution at 464 is brought onto the outer surface of the plates and runs down the outer surface of each of the plates. In some embodiments -described further below- the liquid desiccant runs behind a thin membrane that is located between the air flow and the surface of the plates. Outside air 453 is now blown through the set of wavy plates. The liquid desiccant on the surface of the plates attracts the water vapor in the air flow and the cooling water inside the plates helps to inhibit the air temperature from rising. The plate structures are constructed in such a fashion as to collect the desiccant near the bottom of each plate. The treated air 454 is now put in the building directly without the need for any additional treatment.

The liquid desiccant is collected at the bottom of the wavy plates at 461 and is transported through a heat exchanger 463 to the top of the regenerator to point 465 where the liquid desiccant is distributed across the plates of the regenerator. Return air or optionally outside air 455 is blown across the regenerator plates and water vapor is transported from the liquid desiccant into the leaving air stream 456. An optional heat source 458 provides the driving force for the regeneration. The hot transfer fluid 460 from the heat source can be put inside the plates of the regenerator similar to the cold heat transfer fluid on the conditioner. Again, the liquid desiccant is collected at the bottom of the plates 452 without the need for either a collection pan or bath so that also on the regenerator the air can be vertical. An optional heat pump 466 can be used to provide cooling and heating of the liquid desiccant but can also be used to provide heat and cold as a replacement of cooler 457 and heater 458.

Figure 6:
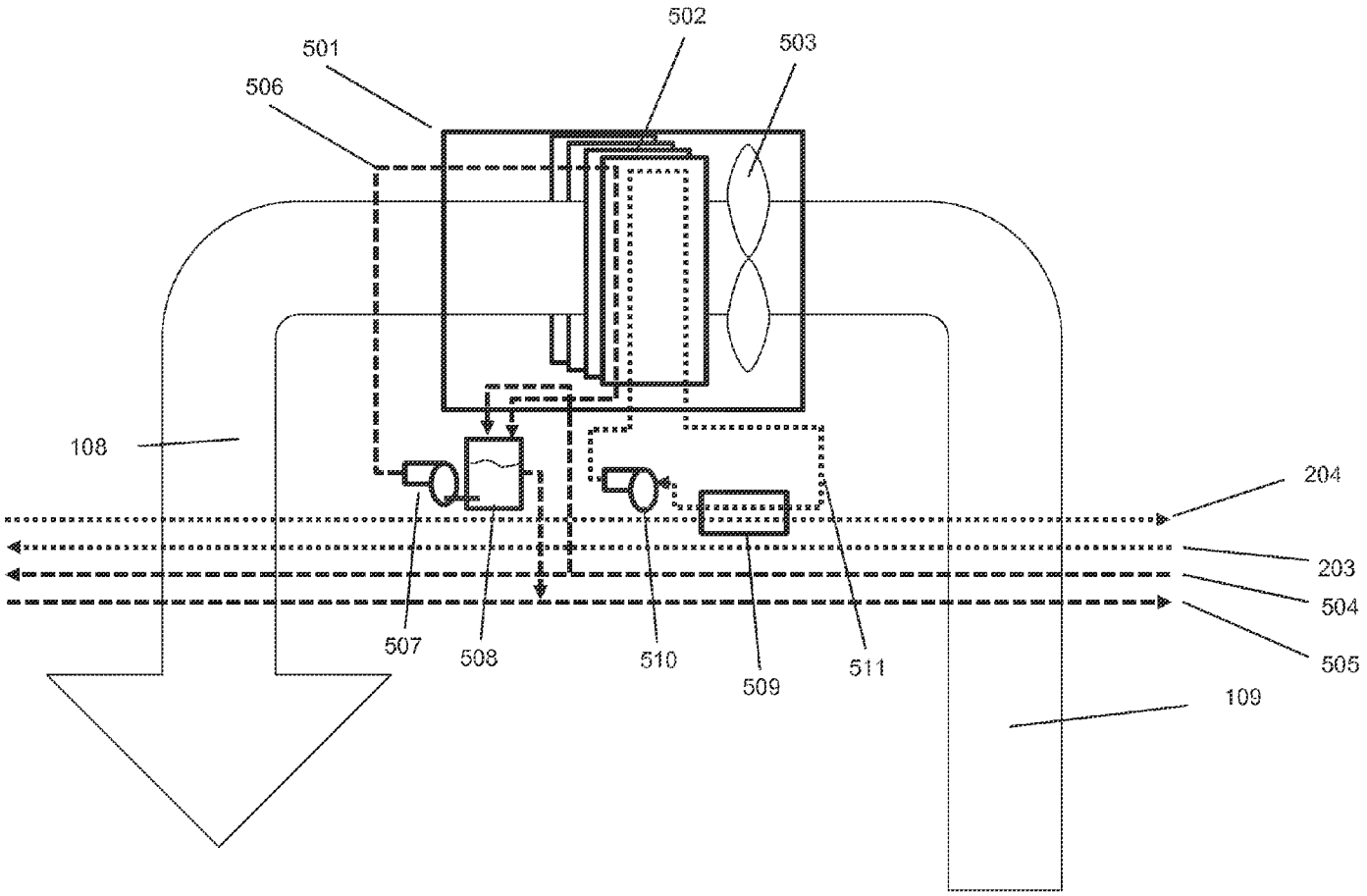
FIG. 6 illustrates a ceiling mounted membrane dehumidification module that is able to cool and dehumidify an air stream in a ceiling mounted location in accordance with one or more embodiments.

FIG. 6 illustrates an in-ceiling fan coil unit 501 in accordance with one or more embodiments that uses a 3-way membrane liquid desiccant module 502 to dehumidify air in a space. Air 109 from the space is pushed by fan 503 through the 3-way membrane module 502 wherein the air is cooled and dehumidified. The dehumidified and cooled air 108 is then ducted to the space where it provides cooling and comfort. The heat that is released during the dehumidification and cooling in the membrane module 502 is rejected to a circulating water loop 511, which circulates from the membrane module 502 to heat exchanger 509 and water pump 510. The heat exchanger 509 receives cold water from building chilled water loop 204, which ultimately rejects the heat of cooling and dehumidification. To achieve the dehumidification function, a desiccant 506 is provided to the membrane module 502. The desiccant drains into a small storage tank 508. Desiccant from the tank 508 is pumped up to the membrane module 502 by liquid desiccant pump 507. Since ultimately the liquid desiccant gets further and further diluted by the dehumidification process, a concentrated desiccant is added by a liquid desiccant loop 504. Dilute liquid desiccant is removed from the tank 508 and pumped through lines 505 to a central regeneration facility (not shown).

Figure 7:
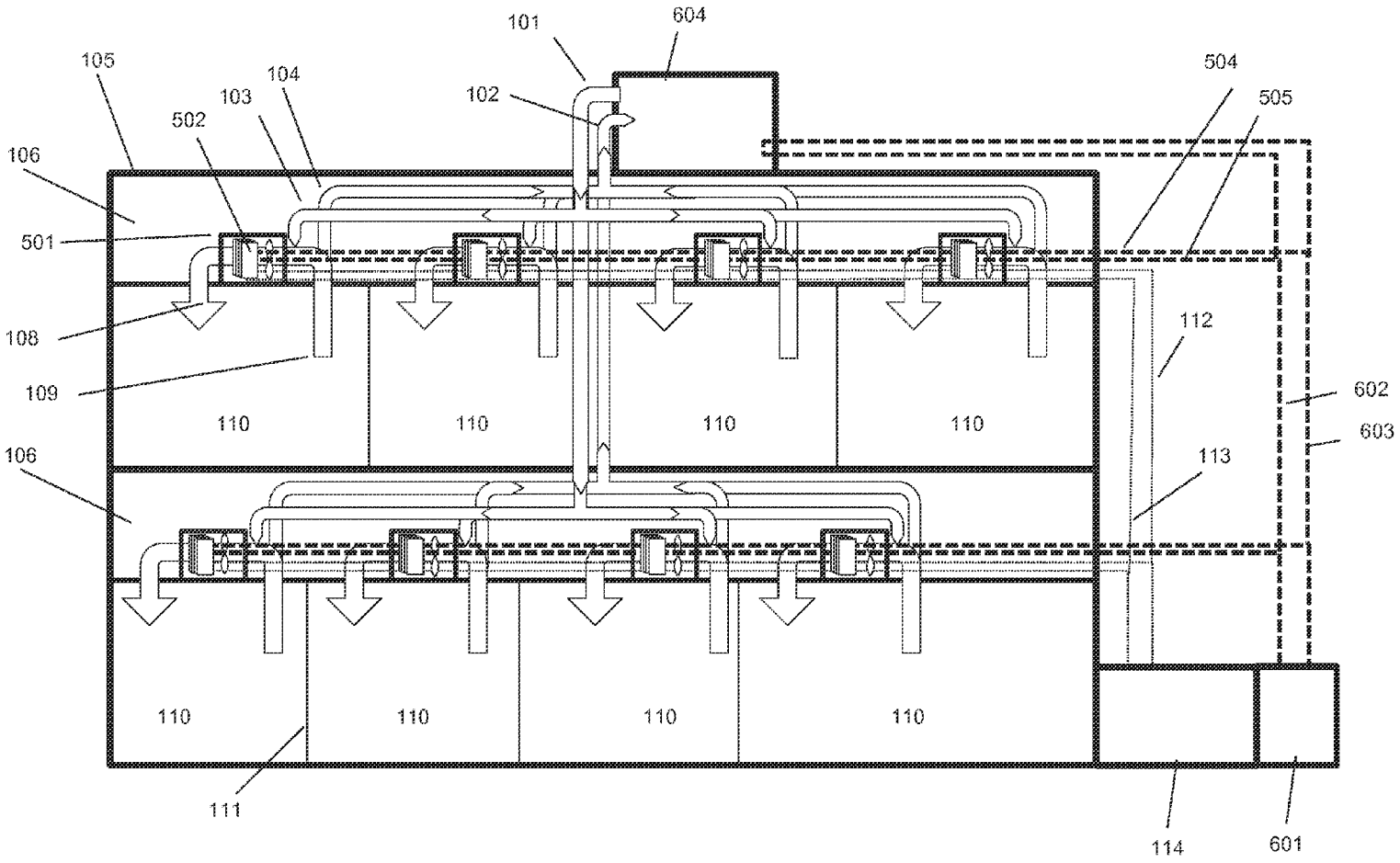
FIG. 7 shows how the system of FIG. 6 can be mounted in a multi-story building simply by replacing the existing fan-coil units in accordance with one or more embodiments.

FIG. 7 illustrates how the in-ceiling liquid desiccant membrane fan-coil unit of FIG. 6 can be deployed in the building of FIG. 1 where it replaces the conventional fan-coil units. As can be seen in the figure, fan-coil unit 501 containing the membrane module 502 is now replacing the conventional fan-coil units. Liquid desiccant distribution lines 504 and 505 a receiving liquid desiccant from a central regeneration system 601. Central liquid desiccant supply lines 602 and 603 can be used to direct liquid desiccant to multiple floors as well as to a roof based liquid desiccant DOAS. The air handling unit 604 can be a conventional non-liquid desiccant DOAS as well.

Figure 8:
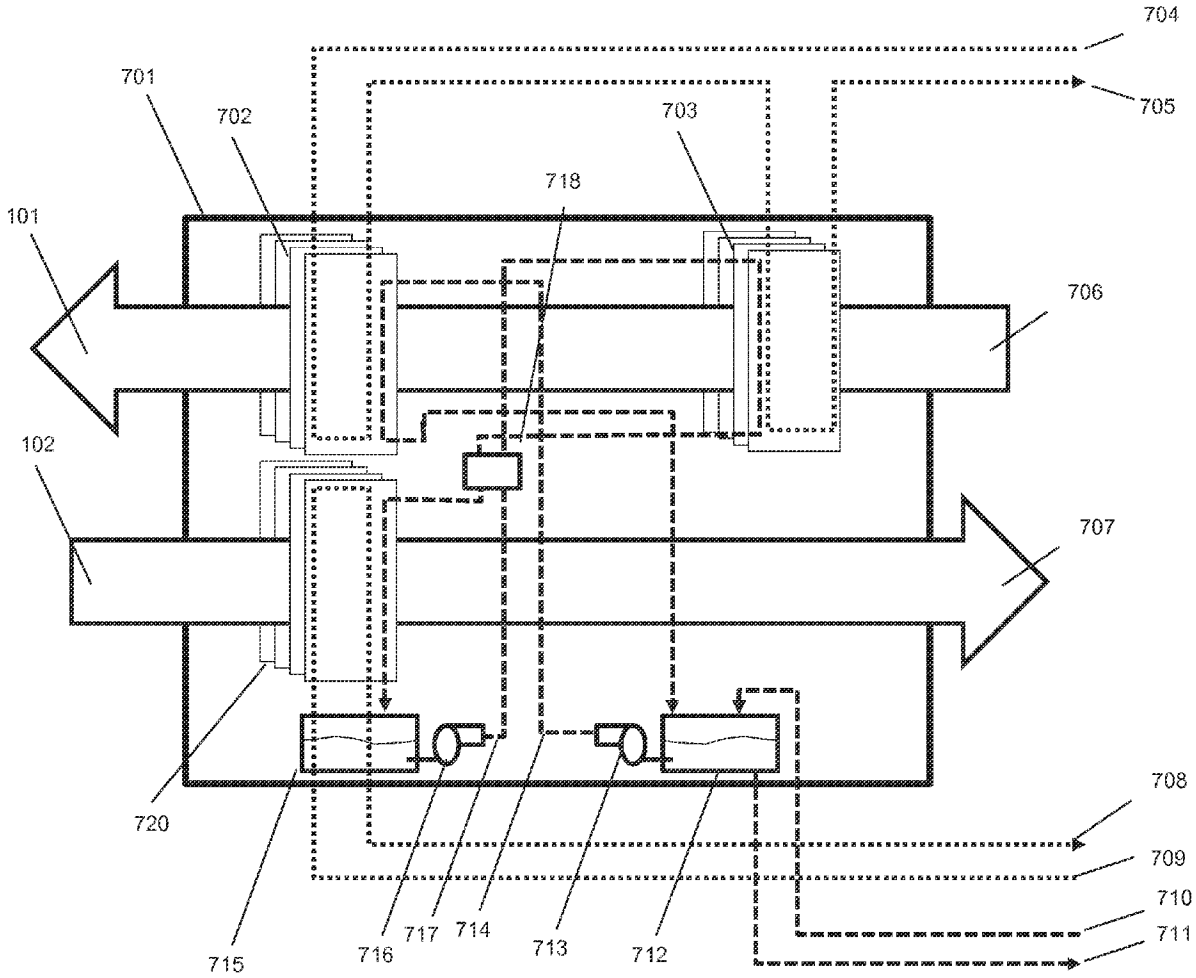
FIG. 8 shows a central air handling unit that uses a set of membrane liquid desiccant modules for energy recovery and a separate module for treating the outside air required for space conditioning in accordance with one or more embodiments.

FIG. 8 illustrates an alternate embodiment of the DOAS 604 of FIG. 7 wherein the system uses liquid desiccant membrane plates similar to plates 452 shown in FIG. 6. The DOAS 701 of FIG. 8 takes outside 706 and directs it through a first set of liquid desiccant membrane plates 703 which are cooled internally by a chilled water loop 704 and dehumidified by a liquid desiccant in a loop 717. The air then proceeds to a second set of liquid desiccant membrane plates 702, which is also cooled internally by the chilled water loop 704. The air stream 706 has thus been dehumidified and cooled twice and proceeds as supply air 101 to spaces in the building as was shown in FIG. 7. The heat released by the cooling and dehumidication processes is released to the chilled water 704 and the water return 705 to a central chiller plant is thus warmer than the incoming chilled water.

Return air 102 from the spaces in the building is directed over a third set of liquid desiccant membrane plates 720. These plates are internally heated by hot water loop 708. The heated air is directed to the outside where it exhausted as air stream 707. The liquid desiccant running over the membrane plates 720 is collected in a small storage tank 715, and is then pumped by pump 716 through loop 717 and liquid-to-liquid heat exchanger 718 to the first set of plates 703. The hot water inside plate set 720 helps to concentrate the desiccant running over the surface of the plate set 704. The concentrated desiccant can then be used to pre-dehumidify the air stream 706 on plate set 703, essentially functioning as a latent energy recovery device. A second desiccant loop 714 is used to further dehumidify the air stream 706 on the second plate set 702. The desiccant is collected in a second storage tank 712, and is pumped by pump 713 through loop 714 to plates 702. Diluted desiccant is removed through desiccant loop 711 and concentrated liquid desiccant is added to the tank 712 by supply line 710.

Figure 9:
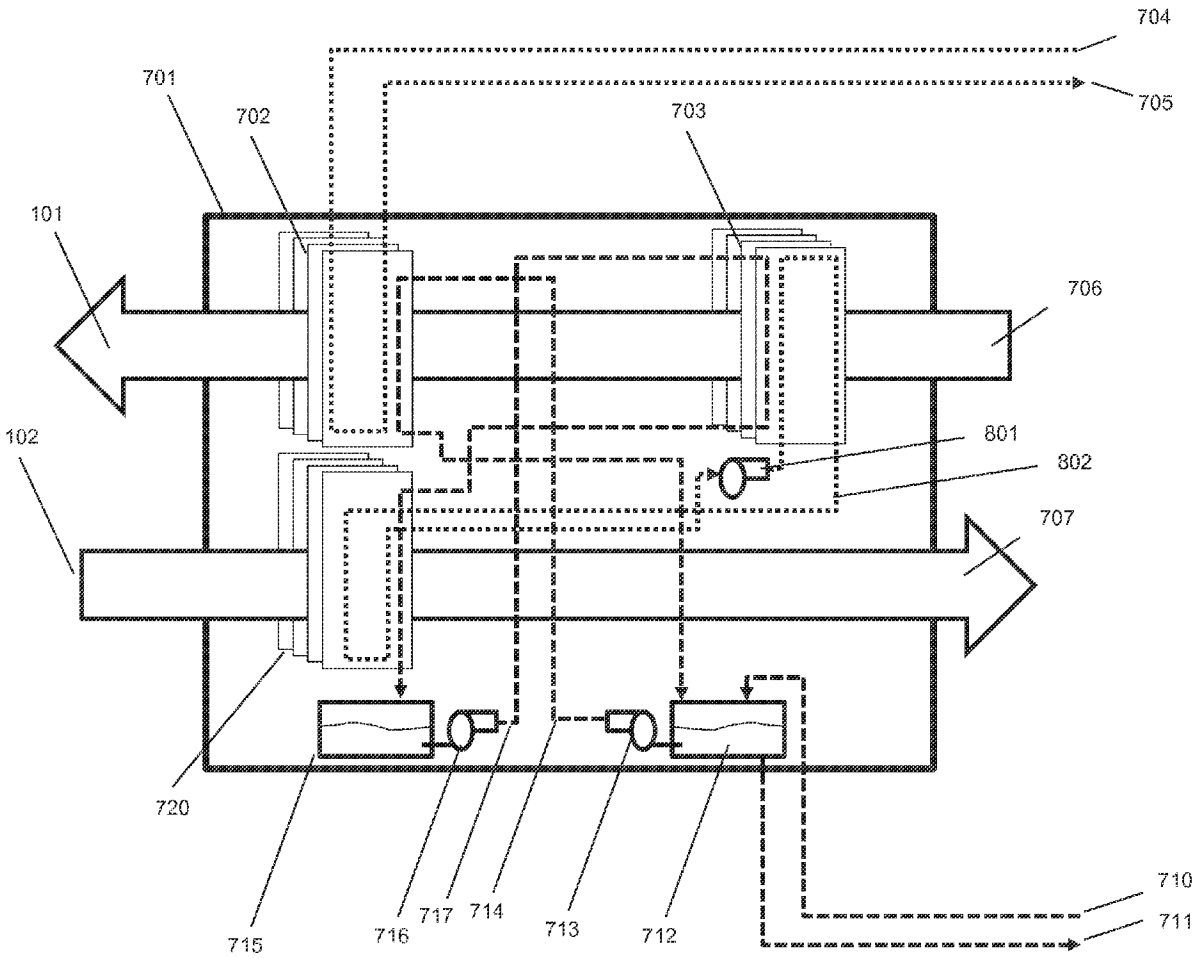
FIG. 9 shows an alternate implementation of the system of FIG. 8 where only chilled water or hot water needs to be provided but not both simultaneously in accordance with one or more embodiments.

FIG. 9 illustrates another embodiment similar to the system of FIG. 8 wherein the hot water loop 708-709 has been omitted. Instead, a circulating water loop 802 provided by run-around pump 801 is used the transfer sensible heat from the incoming air stream. The system thus set up is able to remove moisture from the incoming air stream 706 in the membrane plate set 703 by the liquid desiccant loop 717 and add this moisture to the return air 102 in membrane plate set 704. Simultaneously the heat of the incoming air 706 is moved by the run-around loop 802 and rejected to the return air stream 102. In this manner the system is able to recover both sensible and latent heat from the return air stream 102 and use it to pre-cool and pre-dehumidify the incoming air stream 706. Additional cooling is then provided by the membrane plate set 702 and fresh liquid desiccant is provided by supply line 710 as before.

Figure 10:
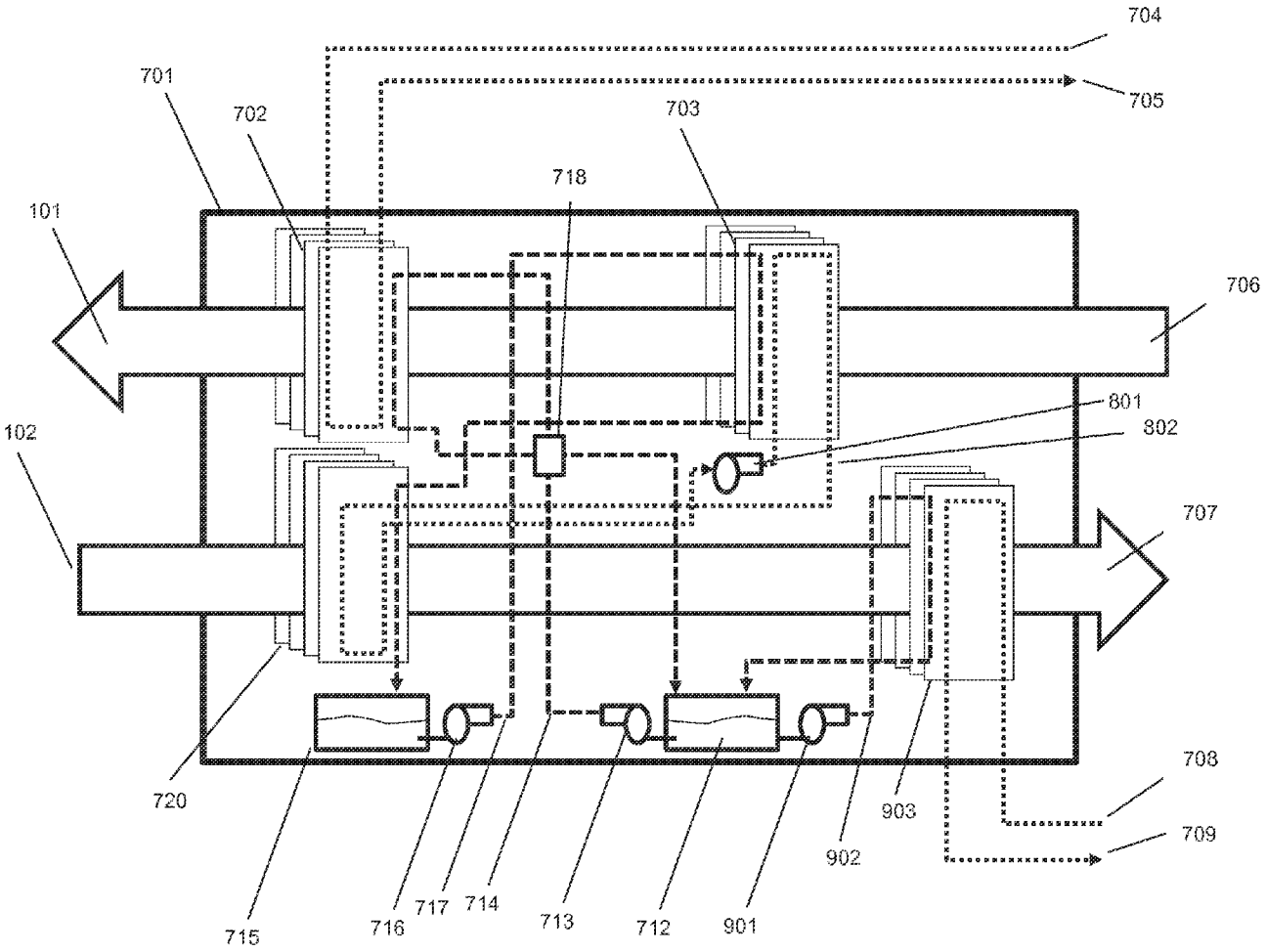
FIG. 10 shows an alternate implementation of the system of FIG. 8 where both cold water and hot water are used simultaneously in accordance with one or more embodiments.

FIG. 10 illustrates yet another embodiment similar to the systems of FIG. 8 and FIG. 9 wherein energy is recovered as was shown in FIG. 9 from the incoming air stream 706 and applied to the return air stream 102. As shown in FIG. 8 the remaining cooling and dehumidification is provided by membrane plate set 702 which is internally cooled by chilled water loop 704. However in this embodiment a fourth set of membrane plates 903 is employed which receives hot water from hot water loop 708. Liquid desiccant is provided by pump 901 and loop 902 and the concentrated liquid desiccant is returned to desiccant tank 712. This arrangement eliminates the need for the external liquid desiccant supply and return lines (710 and 711 in FIG. 8), since the membrane plates 903 function as an integrated regeneration system for the liquid desiccant.

Figure 11:
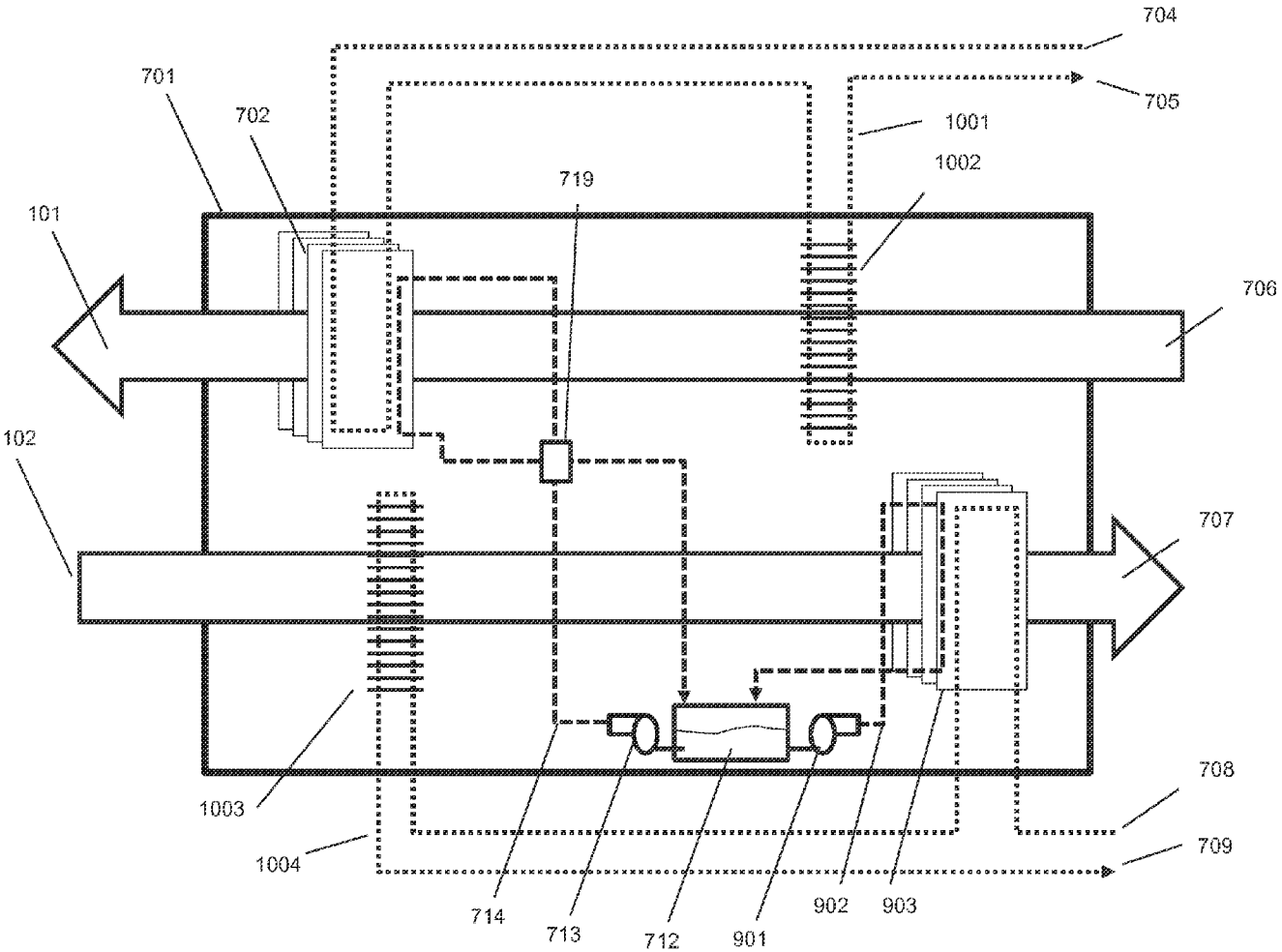
FIG. 11 shows an alternate implementation of the system of FIG. 8 where the chilled water loop is used for pre-cooling air going to the conditioner and the hot water loop is used for preheating air going to the regenerator in accordance with one or more embodiments.

FIG. 11 illustrates another embodiment of the previously discussed systems. In the figure, a pre-cooling coil 1002 is connected by supply 1001 to the chilled water loop 704. The incoming outside air 706 which is typically high in humidity will condense on coil 1002 and water will drain off the coil. The remaining cooling and dehumidification is then again performed by liquid desiccant membrane module 702. The advantage of this arrangement is that the water condensed on the coil does not end up in the desiccant and thus does not need to be regenerated. Also shown in the figure is a preheating coil 1003 supplied by lines 1004 from a hot water loop 708. The pre-heating coil 1003 increases the temperature of the return air stream 102 which enhances the efficiency of the regeneration membrane module 903 since the liquid desiccant 902 is not cooled as much by the air stream 102 as would otherwise be the case.

Figure 12:
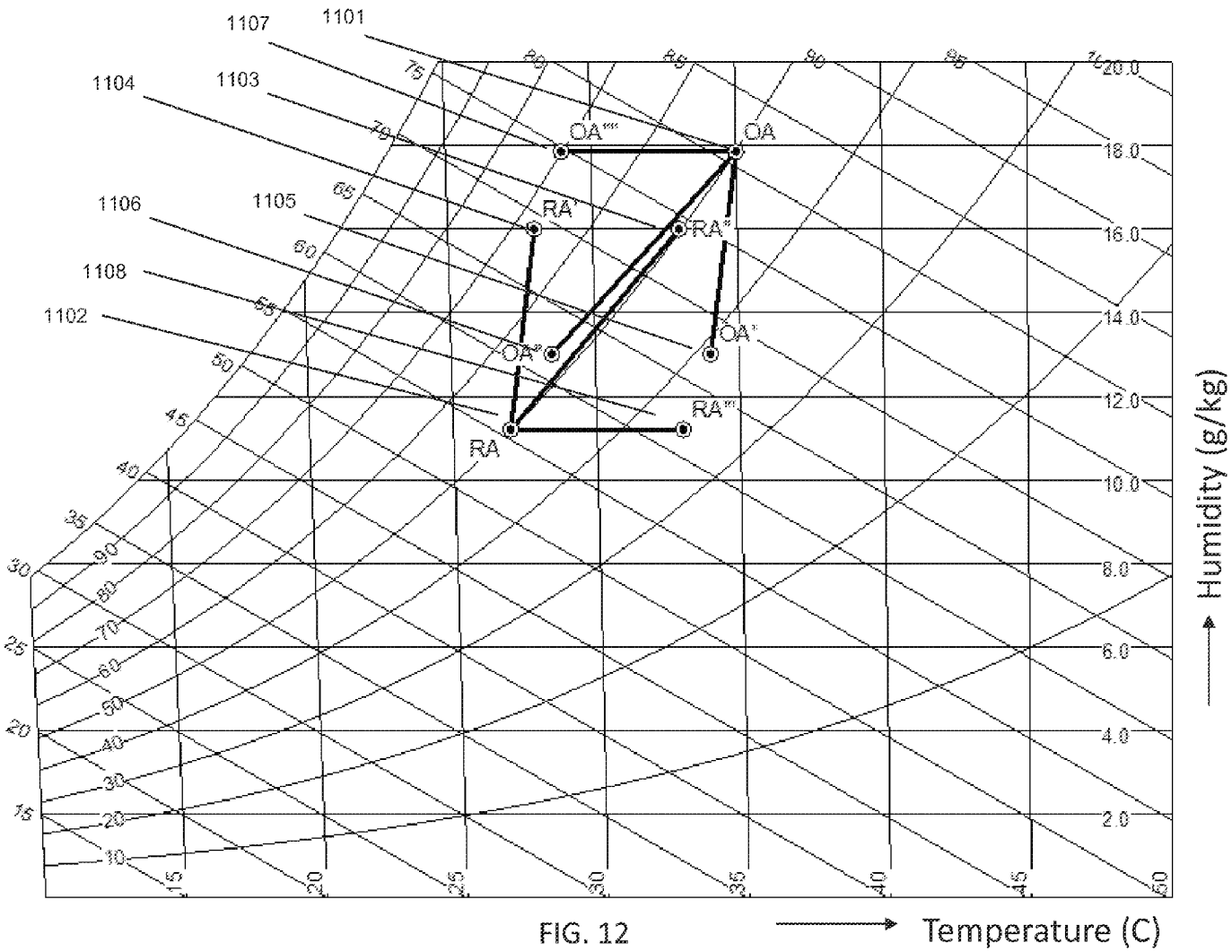
FIG. 12 illustrates an example process (psychrometric) chart of an energy recovery process using 3-way liquid desiccant modules in accordance with one or more embodiments.

FIG. 12 illustrates the psychrometric processes typically involved with the energy recovery methods shown in the previous figures. The horizontal axis shows the dry-bulb temperature (in degrees Celsius) and the vertical axis shows the humidity ratio (in g/kg). Outside Air 1101 (OA) at 35C and 18 g/kg enters the system as does return air 1102 (RA) from the space, which is typically at 26C, 11 g/kg. Latent energy recovery such as was shown in FIG. 8 reduces the humidity of the outside air to a lower humidity (and a somewhat lower temperature) at 1105 (OA'). At the same time the return air absorbs the humidity (and some of the heat) at 1104 (RA'). A sensible energy recovery system would have resulted in points 1107 (OA') and 1108 (RA"). Simultaneous latent and sensible recovery as was shown in FIGS. 9 and 10 results in a transfer of both heat and moisture from the incoming air stream to the return air stream, points 1106 (OA") and 1103 (RA").

In many buildings only a central cold water system is available and there may not be a simple source of hot water available for regeneration of the liquid desiccant. This can be solved by using a system shown in FIG. 13 similar to the central air handling systems of FIG. 8-10, but wherein the primary set of membrane modules 702 is coupled to a building cold water loop as before, but the regeneration is provided by an internal compressor system that is just there to provide heat for liquid desiccant regeneration in membrane modules 1215. It should be clear that like FIG. 8-10, another set of membrane modules 703 and 720 could be provided to provide latent or sensible energy recovery or both, from the leaving air 102 of the building. This is not shown in the figure so as to not overly complicate the figure. It should also be clear that such energy recovery could be provided by other more conventional means such as a desiccant- (enthalpy-) or heat wheels or a heat pipe system or other conventional energy recovery methods such as run-around water loops and air to air heat exchangers. Generally one portion of such an energy recovery system would be implemented in the air stream 102 before it enters the membrane modules 1215, and the other portion of the energy system would be implemented in the air stream 706 before it enters the membrane modules 702. In buildings where little or no return air 102 is available, the air stream 102 can simply be outside air.

Figure 13:
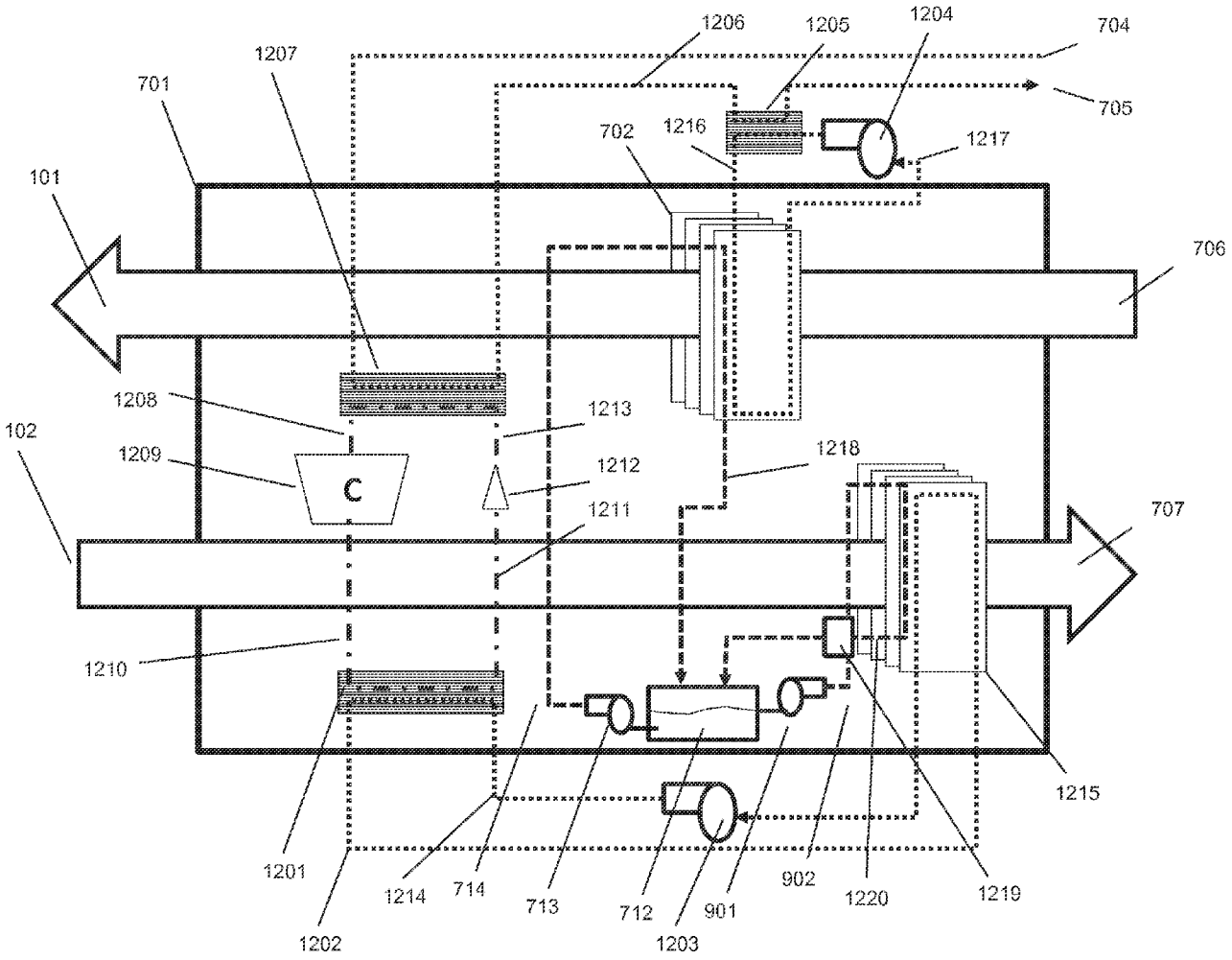
FIG. 13 illustrates a way to provide integration of the central air handling units of FIGS. 8-10 with an existing building cold water system, wherein the central air handling units use a local compressor system just generating heat for regeneration of liquid desiccant in accordance with one or more embodiments.

In FIG. 13 the outside air stream 706 enters a set of 3-way membrane plates or membrane modules 702. The membrane modules 702 receive a heat transfer fluid 1216 that is provided by liquid pump 1204 through water-to-water heat exchanger 1205. The heat exchanger 1205 is a convenient way to provide pressure isolation between the usually higher (60-90 psi) building water circuit 704 and the low pressure heat transfer fluid circuit 1216/1217 which is generally only 0.5-2 psi. The heat transfer fluid 1216 is cooled down by the building water 704 in the heat exchanger 1205. The leaving building cooling water 1206 also is directed through a water-to-refrigerant heat exchanger 1207 which is coupled to a conventional water-to-water heat pump. The cold heat transfer fluid 1216 provides cooling to the membrane modules 702 which also receive a concentrated liquid desiccant 714. The liquid desiccant 714 is pumped by pump 713 and absorbs water vapor from the air stream 706 and the air is simultaneously cooled and dehumidified as is discussed, e.g., in U.S. Patent Application Publication No. 2014-0150662, and is supplied to the building as supply air 101. The diluted liquid desiccant 1218 that leaves the membrane modules 702 is collected in desiccant tank 712 and now needs to be regenerated. A conventional compressor system (known in the HVAC industry as a water-to-water heat pump) comprising of compressor 1209, a liquid-to-refrigerant condenser heat exchanger 1201, an expansion device 1212 and a liquid to refrigerant evaporator heat exchanger 1207. Gaseous refrigerant 1208 leaves the evaporator 1207 and enters the compressor 1209 where the refrigerant is compressed, which releases heat. The hot, gaseous refrigerant 1210 enters the condenser heat exchanger 1201 where the heat is removed and transferred into heat transfer fluid 1214 and the refrigerant is condensed to a liquid. The liquid refrigerant 1211 then enters the expansion device 1212 where it rapidly cools. The cold liquid refrigerant 1213 then enters the evaporator heat exchanger 1207 where it picks up heat from the building water loop 704, thereby reducing the temperature of the building water. The thus heated heat transfer fluid 1214 creates a hot liquid heat transfer fluid 1202 which is directed to the regenerator membrane modules 1215 which are similar in nature to conditioner membrane modules 702 but could be sized differently to account for differences in air streams and temperatures. The hot heat transfer fluid 1202 now causes the dilute liquid desiccant 902 to release its excess water in the membrane modules 1215 which is exhausted into the air stream 102 resulting in a hot, humid air stream 707 leaving said membrane modules 1215. An economizer heat exchanger 1219 can be employed to reduce the heat load from the regenerator hot liquid desiccant 1220 to the cold liquid desiccant in the desiccant tank 712.

The hot heat transfer fluid is pumped by pump 1203 to the regenerator membrane modules 1215, and the cooler heat transfer fluid 1214 is directed back to the condenser heat exchanger 1201 where it again picks up heat. The advantage of the setup discussed above is clear: the local water-to-water heat pump is only used if liquid desiccant needs to be regenerated and thus can be used at times when electricity is inexpensive since concentrated liquid desiccant can be stored in tank 712 for use when needed. Furthermore, when the water-to-water heat pump is running, it actually cools the building water loop 704 down, thereby reducing the heat load on the central chilled water plant. Also when a building only has a cold water loop, which is commonly the case, there is no need to install a central hot water system. And lastly the regeneration system could be made to work even if no return air is available, and if there is return air, an energy wheel or conventional energy recovery system can be added, or a separate set of liquid desiccant energy recovery modules such as shown in FIGS. 8-10 can be added.

Figure 14:
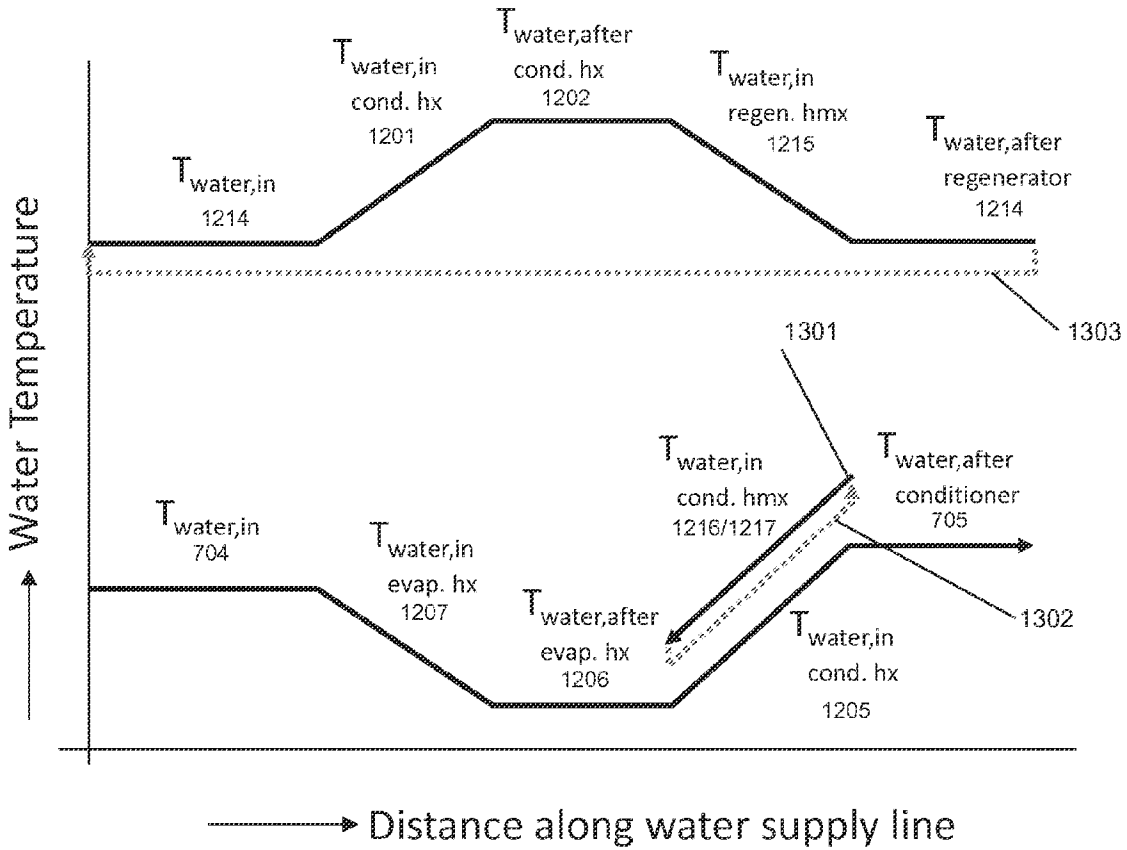
FIG. 14 illustrates the effect that the system of FIG. 13 has on the water temperatures in the building and air handling unit in accordance with one or more embodiments.

FIG. 14 illustrates the temperatures of the heat transfer fluid (often plain water) in the water lines of the system of FIG. 13. The building water 704 enters at temperature $T_{water,in}$ into the evaporator heat exchanger 1207. The heat transfer fluid is cooled by the refrigerant in the evaporator 1207 as discussed above resulting in the fluid leaving at temperature $T_{water,after\ evap.hx}$ 1206. The heat transfer fluid then enters the conditioner heat exchanger 1205 where it picks up heat from the conditioner fluid loop 1216/1217. The run-around heat transfer loop 1216/1217 (indicated by temperature profile 1301 and 1302 in the heat exchanger 1205) is usually implemented in a counter-flow orientation resulting in a slightly warmer water temperature $T_{water,\ in\ cond.hmx}$ that services the membrane modules 702. The heat transfer fluid then leaves the system at 705 and is returned to the central chiller plant (not shown) where it is cooled down. It should be obvious that the heat exchangers 1205 and 1207 can also be reversed in order or operated in parallel. The order of the heat exchangers makes little difference in operating energy, but will affect the outlet temperature for the supply air 701: generally the supply air 701 will be colder if the building water enters heat exchanger 1207 first (as shown). Warmer air is provided if the building water enters heat exchanger 1205 first (as would happen if the flow from 704 to 705 is reversed). This obviously also can be used to provide a temperature control mechanism for the supply air.

The regeneration heat transfer fluid loop is also illustrated in FIG. 14. The heat transfer fluid (often water) having temperature $T_{water}$, in 1214 entering the condenser heat exchanger 1201 is first heated by the refrigerant resulting in temperature $T_{water,\ after\ cond.hx}$ in 1202. The hot heat transfer fluid 1202 is then directed to the regenerator membrane module resulting in $T_{water,\ after\ regenerator}$ in 1214. Since this is also a closed loop the water temperature is then the same as it was at the beginning of the graph as indicated by arrow 1303. For simplicity small parasitic temperature increases such as those caused by pumps and small losses such as those caused by pipe losses have been omitted from the figure.

Having thus described several illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments. Additionally, elements and components described herein may be further divided into additional components or joined together to form fewer components for performing the same functions. Accordingly, the foregoing description and attached drawings are by way of example only, and are not intended to be limiting.

What is claimed is:

1. An air-conditioning system for treating air in spaces within a building, comprising:

a plurality of in-ceiling units, each installed in the building for treating air in a space in the building, each in-ceiling unit comprising a conditioner including a plurality of structures arranged in a substantially vertical orientation, each of the structures having at least one surface across which a liquid desiccant can flow and an internal passage through which a heat transfer fluid can flow, each of the structures further including a separate desiccant collector at a lower end of the at least one surface for collecting liquid desiccant that has flowed across the at least one surface of the structures, said desiccant collectors being spaced apart from each other to permit airflow therebetween, each in-ceiling unit also comprising a fan or blower for flowing an air stream from a space in the building between the structures of the conditioner, wherein the air stream is cooled and dehumidified, and then transferring the air stream to a space in the building;

a liquid desiccant regeneration system connected to each of said in-ceiling units configured to concentrate the liquid desiccant received from the in-ceiling units, and to supply concentrated liquid desiccant to the in-ceiling units; and a cold source connected to each of said in-ceiling units configured to cool the heat transfer fluid.

2. The air conditioning system of claim 1, further comprising a dedicated outside air system (DOAS) for providing a stream of treated outside air to the building.

3. The air conditioning system of claim 2, wherein said DOAS is configured to exchange energy between an air stream received from outside the building and a return air stream from a space inside the building.

4. The air conditioning system of claim 2, wherein said DOAS is connected to each of said in-ceiling units to provide the stream of treated outside air to the plurality of in-ceiling units to be treated by the in-ceiling units with the air stream from a space inside the building.

5. The air conditioning system of claim 1, further comprising a sheet of material positioned proximate to the at least one surface of each structure in each of the in ceiling units between the liquid desiccant and the air stream flowing through each in-ceiling unit, said sheet of material guiding the liquid desiccant into a desiccant collector and permitting transfer of water vapor between the liquid desiccant and the air stream.

6. The air conditioning system of claim 4, wherein the sheet of material comprises a membrane, a hydrophilic material, or a hydrophobic micro-porous membrane.

7. The air conditioning system of claim 1, wherein the cold source comprises a chilled water loop.

8. The air conditioning system of claim 1, wherein the system is also operable in a cold weather operation mode, wherein the air stream treated by each of the in-ceiling units is heated and humidified, the system further comprising a heat source connected to each of said in-ceiling units configured to heat the heat transfer fluid in the cold weather operation mode.

9. A dedicated outside air system (DOAS) for providing a stream of treated outside air to a building, comprising:

a first conditioner for treating an air stream received from outside the building, the first conditioner including a plurality of structures arranged in a substantially vertical orientation, each of the structures having at least one surface across which a liquid desiccant can flow and an internal passage through which a heat transfer fluid can flow, wherein the air stream received from outside the building flows between the structures such that the liquid desiccant dehumidifies and cools the air stream, each of the structures further including a separate desiccant collector at a lower end of the at least one surface of the structures for collecting liquid desiccant that has flowed across the at least one surface of the structures, said desiccant collectors being spaced apart from each other to permit airflow therebetween;

a cold source connected to said first conditioner for cooling the heat transfer fluid in the first conditioner;

a regenerator connected to the first conditioner for receiving the liquid desiccant used in the first conditioner, concentrating the liquid desiccant, and returning concentrated liquid desiccant to the first conditioner, the regenerator including a plurality of structures arranged in a substantially vertical orientation, each of the structures having at least one surface across which the liquid desiccant can flow and an internal passage through which a heat transfer fluid can flow, wherein an air stream flows between the structures such that the liquid desiccant humidifies and heats the air stream, each of the structures further including a separate desiccant collector at a lower end of the at least one surface of the structures for collecting liquid desiccant that has flowed across the at least one surface of the structures, said desiccant collectors being spaced apart from each other to permit airflow therebetween; and a heat source connected to the regenerator for heating the heat transfer fluid in the regenerator.

10. The system of claim 9, further comprising a second conditioner for treating an air stream treated by the first conditioner, the second conditioner including a plurality of structures arranged in a substantially vertical orientation, each of the structures having at least one surface across which a liquid desiccant can flow and an internal passage through which a heat transfer fluid can flow, wherein the air stream received from the first conditioner flows between the structures such that the liquid desiccant dehumidifies and cools the air stream, each of the structures further including a separate desiccant collector at a lower end of the at least one surface of the structures for collecting liquid desiccant that has flowed across the at least one surface of the structures, said desiccant collectors being spaced apart from each other to permit airflow therebetween.

11. The system of claim 10, wherein the cold source is also connected to said second conditioner for cooling the heat transfer fluid in the second conditioner.

12. The system of claim 10, wherein the liquid desiccant used in the second conditioner is transferred to a central regeneration facility for reconcentrating diluted desiccant.

13. The system of claim 9, wherein the cold source comprises a chilled water loop, and the heat source comprises a hot water loop.

14. The system of claim 9, further comprising a sheet of material positioned proximate to the at least one surface of each structure in the first conditioner and the regenerator between the liquid desiccant and the air stream flowing through the conditioner and regenerator, said sheet of material guiding the liquid desiccant into a desiccant collector and permitting transfer of water vapor between the liquid desiccant and the air stream.

15. The system of claim 14, wherein the sheet of material comprises a membrane, a hydrophilic material, or a hydrophobic micro-porous membrane.

16. The system of claim 9, wherein the system is also operable in a cold weather operation mode, wherein the air stream treated by the first conditioner is heated and humidified, and wherein the air stream treated by the regenerator is cooled and dehumidified, and wherein the system further comprising a cold source connected to said regenerator configured to cool the heat transfer fluid in the cold weather operation mode.

17. A dedicated outside air system (DOAS) for cooling and dehumidifying an outside air stream provided to a building and recovering sensible and latent heat from a return air stream from the building, comprising:

a first conditioner for treating an air stream received from outside the building, the first conditioner including a plurality of structures arranged in a substantially vertical orientation, each of the structures having at least one surface across which a liquid desiccant can flow and an internal passage through which a heat transfer fluid can flow, wherein the air stream received from outside the building flows between the structures such that the liquid desiccant dehumidifies and cools the air stream, each of the structures further including a separate desiccant collector at a lower end of the at least one surface of the structures for collecting liquid desiccant that has flowed across the at least one surface of the structures, said desiccant collectors being spaced apart from each other to permit airflow therebetween; and a first regenerator connected to the first conditioner for receiving the liquid desiccant used in the first conditioner, concentrating the liquid desiccant, and returning concentrated liquid desiccant to the first conditioner, the first regenerator is also connected to the first conditioner for receiving the heat transfer fluid used in the first conditioner, cooling the heat transfer fluid, and returning cooled heat transfer fluid to the first conditioner, the first regenerator including a plurality of structures arranged in a substantially vertical orientation, each of the structures having at least one surface across which the liquid desiccant can flow and an internal passage through which the heat transfer fluid can flow, wherein a return air stream received from a space inside the building flows between the structures such that the liquid desiccant humidifies and heats the air stream, each of the structures further including a separate desiccant collector at a lower end of the at least one surface of the structures for collecting liquid desiccant that has flowed across the at least one surface of the structures, said desiccant collectors being spaced apart from each other to permit airflow therebetween.

18. The system of claim 17, further comprising a second conditioner for treating an air stream treated by the first conditioner, the second conditioner including a plurality of structures arranged in a substantially vertical orientation, each of the structures having at least one surface across which a liquid desiccant can flow and an internal passage through which a heat transfer fluid can flow, wherein the air stream received from the first conditioner flows between the structures such that the liquid desiccant dehumidifies and cools the air stream, each of the structures further including a separate desiccant collector at a lower end of the at least one surface of the structures for collecting liquid desiccant that has flowed across the at least one surface of the structures, said desiccant collectors being spaced apart from each other to permit airflow therebetween.

19. The system of claim 18, further comprising a cold source connected to said second conditioner for cooling the heat transfer fluid in the second conditioner.

20. The system of claim 19, wherein the cold source comprises a chilled water loop.

21. The system of claim 18, wherein the system is also operable in a cold weather operation mode, wherein the air stream treated by the first conditioner is heated and humidified, and wherein the air stream treated by the regenerator is cooled and dehumidified, the system further comprising a heat source connected to said second conditioner for heating the heat transfer fluid in the second conditioner in the cold weather operation mode.

22. The system of claim 21, wherein the heat source comprises a hot water loop.

23. The system of claim 21, further comprising a desiccant treatment facility connected to the second conditioner for diluting the liquid desiccant used in the second conditioner in the cold weather operation mode.

24. The system of claim 18, further comprising a regenerator connected to the second conditioner for concentrating the liquid desiccant used in the second conditioner.

25. The system of claim 17, further comprising a sheet of material positioned proximate to the at least one surface of each structure in the first conditioner and the first regenerator between the liquid desiccant and the air stream flowing through the conditioner and first regenerator, said sheet of material guiding the liquid desiccant into a desiccant collector and permitting transfer of water vapor between the liquid desiccant and the air stream.

26. The system of claim 25, wherein the sheet of material comprises a membrane, a hydrophilic material, or a hydrophobic micro-porous membrane.

27. The system of claim 18, further comprising a second regenerator connected to the second conditioner for receiving the liquid desiccant used in the second conditioner, concentrating the liquid desiccant, and returning concentrated liquid desiccant for use in the second conditioner, said second regenerator coupled to the first regenerator for treating the air stream treated by the first regenerator, the second regenerator including a plurality of structures arranged in a substantially vertical orientation, each of the structures having at least one surface across which a liquid desiccant can flow and an internal passage through which a heat transfer fluid can flow, wherein the air stream received from the first regenerator flows between the structures such that the liquid desiccant further humidifies and heats the air stream, each of the structures further including a separate desiccant collector at a lower end of the at least one surface of the structures for collecting liquid desiccant that has flowed across the at least one surface of the structures, said desiccant collectors being spaced apart from each other to permit airflow therebetween.

28. The system of claim 27, further comprising a heat source connected to the second regenerator for heating the heat transfer fluid in the second regenerator.

29. The system of claim 28, wherein the heat source comprises a hot water loop.

30. The system of claim 17, further comprising a pre-cooling coil for cooling and dehumidifying the air stream received from outside the building prior to treatment by the first conditioner.

31. The system of claim 17, further comprising a pre-heating coil for heating the return air stream prior to treatment by the first regenerator.

32. The system of claim 17, wherein the system is also operable in a cold weather operation mode, wherein the air stream treated by the first conditioner is heated and humidified, and the air stream treated by the regenerator is cooled and dehumidified, the system further comprising a pre-heating coil for heating the air stream received from outside the building prior to treatment by the first conditioner and a pre-cooling coil for cooling and dehumidifying the return air stream prior to treatment by the first regenerator.

33. An air conditioning system for a building having a cold fluid circuit, comprising:

a conditioner for treating an air stream, the conditioner utilizing a liquid desiccant and a heat transfer fluid to dehumidify and cool the air stream;

a regenerator connected to the conditioner for receiving the liquid desiccant used in the conditioner, concentrating the liquid desiccant, and returning concentrated liquid desiccant to the conditioner, the regenerator heating the liquid desiccant by using a heat transfer fluid; and a heat pump coupled to the cold fluid circuit and to a local hot heat transfer fluid loop circulating the heat transfer fluid in the regenerator, said heat pump pumping heat from fluid in the cold fluid circuit into the heat transfer fluid in the local hot heat transfer fluid loop.

34. The system of claim 33, wherein fluid in the cold fluid circuit cooled by the heat pump is utilized to cool the heat transfer fluid in the conditioner.

35. The system of claim 34, wherein the heat pump cools the fluid in the cold fluid circuit before, after, or in parallel with cooling of the heat transfer fluid in the conditioner by fluid in the cold fluid circuit.

36. The system of claim 33, wherein the conditioner comprises a plurality of structures arranged in a substantially vertical orientation, each of the structures having at least one surface across which a liquid desiccant can flow and an internal passage through which the heat transfer fluid can flow, wherein the air stream received from outside the building flows between the structures such that the liquid desiccant dehumidifies and cools the air stream, each of the structures further including a separate desiccant collector at a lower end of the at least one surface of the structures for collecting liquid desiccant that has flowed across the at least one surface of the structures, said desiccant collectors being spaced apart from each other to permit airflow therebetween.

37. The air conditioning system of claim 36, further comprising a sheet of material positioned proximate to the at least one surface of each structure in the first conditioner between the liquid desiccant and the air stream flowing through the first conditioner, said sheet of material guiding the liquid desiccant into a desiccant collector and permitting transfer of water vapor between the liquid desiccant and the air stream.

38. The system of claim 37, wherein the sheet of material comprises a membrane, a hydrophilic material, or a hydrophobic micro-porous membrane.

39. The system of claim 33, wherein the regenerator includes a plurality of structures arranged in a substantially vertical orientation, each of the structures having at least one surface across which the liquid desiccant can flow and an internal passage through which a heat transfer fluid can flow, wherein an air stream flows between the structures such that the liquid desiccant humidifies and heats the air stream, each of the structures further including a separate desiccant collector at a lower end of the at least one surface of the structures for collecting liquid desiccant that has flowed across the at least one surface of the structures, said desiccant collectors being spaced apart from each other to permit airflow therebetween.

40. The air conditioning system of claim 36, further comprising a sheet of material positioned proximate to the at least one surface of each structure in the first conditioner between the liquid desiccant and the air stream flowing through the first conditioner, said sheet of material guiding the liquid desiccant into a desiccant collector and permitting transfer of water vapor between the liquid desiccant and the air stream.

41. The system of claim 40, wherein the sheet of material comprises a membrane, a hydrophilic material, or a hydrophobic micro-porous membrane.

42. The system of claim 33, wherein the system is also operable in a cold weather operation mode, wherein the cold fluid circuit includes a hot fluid, and the direction of the refrigerant flow in the heat pump is reversed to heat the heat transfer fluid in the conditioner and cool the heat transfer fluid in the regenerator.

43. The system of claim 33, wherein the system is also operable in a cold weather operation mode, wherein the cold fluid circuit includes a hot fluid, and the heat pump is inactive.

* * * * *